US012286810B2

(12) United States Patent
Robinson

(10) Patent No.: US 12,286,810 B2
(45) Date of Patent: Apr. 29, 2025

(54) DEVICES AND SYSTEMS FOR DISPLACEMENT CONTROL IN SEISMIC BRACES AND YIELDING LINKS

(71) Applicant: Kimberley S. Robinson, Sandy, UT (US)

(72) Inventor: Kimberley S. Robinson, Sandy, UT (US)

( * ) Notice: Subject to any disclaimer, the term of this patent is extended or adjusted under 35 U.S.C. 154(b) by 350 days.

(21) Appl. No.: 17/505,218

(22) Filed: Oct. 19, 2021

(65) Prior Publication Data

US 2023/0117355 A1 Apr. 20, 2023

(51) Int. Cl.
*E04H 9/02* (2006.01)
*E04B 1/24* (2006.01)

(52) U.S. Cl.
CPC ..... *E04H 9/024* (2013.01); *E04B 1/2403* (2013.01); *E04B 2001/2442* (2013.01)

(58) Field of Classification Search
CPC ..... E04H 9/024; E04H 9/0237; E04B 1/2403; E04B 2001/2496
USPC ..... 52/167.1
See application file for complete search history.

(56) References Cited

U.S. PATENT DOCUMENTS 1,804,320 A 5/1931 Cross
5,471,810 A * 12/1995 Sugisawa ..... E04C 3/04 52/847
6,530,182 B2 3/2003 Fanucci et al.
6,826,874 B2 12/2004 Takeuchi et al.
7,174,680 B2 2/2007 Smelser
7,185,462 B1 * 3/2007 Smelser ..... E04H 9/0237 52/638
7,188,452 B2 3/2007 Sridhara
7,284,358 B2 10/2007 Smelser
7,305,799 B2 * 12/2007 Smelser ..... E04C 3/02 52/855
7,716,882 B2 5/2010 Smelser
7,762,026 B2 7/2010 Smelser
8,424,252 B2 * 4/2013 Tsai ..... E04H 9/0237 52/223.4

(Continued)

FOREIGN PATENT DOCUMENTS

CN 105442719 3/2016
CN 105442719 A * 3/2016

(Continued)

OTHER PUBLICATIONS

Robinson, K.S., "Advances in design requirements for Buckling Restrained Braced frames", 2014 NZSEE Conference, Paper No. 11, Mar. 21, 2014, 8 pages.

(Continued)

*Primary Examiner* — Paola Agudelo
*Assistant Examiner* — Adam G Barlow
(74) *Attorney, Agent, or Firm* — RAY, QUINNEY & NEBEKER; Thomas L. Lingard

(57) ABSTRACT

A yielding seismic element includes one or more displacement control elements connected to a yielding element. The yielding element is designed to deform under seismic forces. When the yielding element experiences an instance of local deformation, the displacement control elements interact with a displacement restraint fixed relative to the yielding element. The displacement restraint prevents further deformation at the instance of local deformation.

12 Claims, 23 Drawing Sheets

(56) References Cited

U.S. PATENT DOCUMENTS

| | | | | |
|---|---|---|---|---|
| 8,590,258 | B2 * | 11/2013 | Hinchman | E04H 9/0237 52/167.2 |
| 8,763,320 | B1 * | 7/2014 | Chou | E04H 12/16 52/167.3 |
| 9,003,723 | B2 * | 4/2015 | Ueki | E04H 9/0237 52/843 |
| 9,016,007 | B2 | 4/2015 | Marinovic et al. | |
| 9,593,504 | B2 | 3/2017 | Marinovic et al. | |
| 9,989,349 | B2 | 6/2018 | Saxey et al. | |
| 10,316,507 | B2 | 6/2019 | Richards | |
| 10,876,281 | B2 * | 12/2020 | Allen | E04B 1/2403 |
| 2001/0000840 | A1 | 5/2001 | Takeuchi et al. | |
| 2003/0221389 | A1 * | 12/2003 | Smelser | E04C 3/02 52/853 |
| 2004/0190981 | A1 * | 9/2004 | Tsai | E04H 9/0237 403/293 |
| 2005/0257490 | A1 | 11/2005 | Pryor et al. | |
| 2006/0101733 | A1 * | 5/2006 | Jen | E04H 9/0237 52/167.1 |
| 2007/0240368 | A1 * | 10/2007 | Tsai | E04H 9/0237 52/167.3 |
| 2008/0083173 | A1 | 4/2008 | Smelser | |
| 2008/0250732 | A1 * | 10/2008 | Tsai | E04H 9/0237 52/167.3 |
| 2009/0211180 | A1 | 8/2009 | Smelser | |
| 2010/0005737 | A1 * | 1/2010 | Tsai | E04H 9/0237 52/167.3 |
| 2015/0000228 | A1 * | 1/2015 | Dusicka | E04C 3/29 52/835 |
| 2015/0259899 | A1 | 9/2015 | Tsai | |
| 2016/0060888 | A1 | 3/2016 | Reaveley et al. | |
| 2020/0011051 | A1 * | 1/2020 | Hou | E04G 23/02 |

FOREIGN PATENT DOCUMENTS

| | | |
|---|---|---|
| CN | 205712557 | 11/2016 |
| CN | 107882201 | 4/2018 |
| EP | 1415757 | 5/2004 |
| JP | H09-111719 | 4/1997 |
| JP | 2002167863 | 6/2002 |
| JP | 2006257674 | 9/2006 |
| JP | 2010168865 | 8/2010 |
| JP | 4665232 | 4/2011 |
| JP | 2012229572 | 11/2012 |
| JP | 2013028937 | 2/2013 |
| JP | 2014001505 | 1/2014 |
| JP | 2015045132 | 3/2015 |
| JP | 2015224451 | 12/2015 |
| JP | 2017101482 | 6/2017 |
| JP | 2018009294 | 1/2018 |
| JP | 2018506662 | 3/2018 |
| JP | 2018193737 | 12/2018 |
| KR | 20110101946 | 9/2011 |
| KR | 101733091 | 5/2017 |
| TW | 201000722 | 1/2010 |
| WO | WO 2015/018223 | 2/2015 |
| WO | WO 2015/106520 | 7/2015 |

OTHER PUBLICATIONS

Robinson, K.S., "Brace Yourself!", Building Blocks, Structure Magazine, Aug. 2012, pp. 8-10.

International Search Report and Written Opinion from PCT/US/2022/047145, mailed Mar. 24, 2023, 12 pages.

* cited by examiner

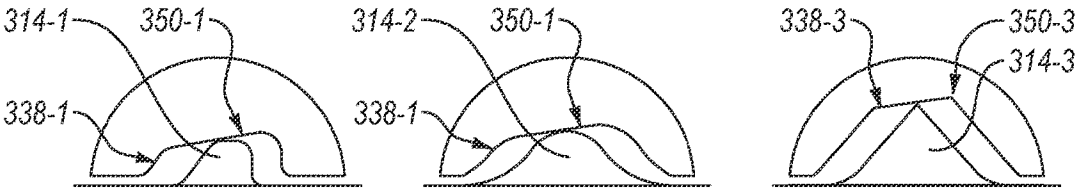
FIG. 3-1
FIG. 3-2
FIG. 3-3
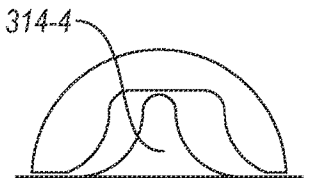
FIG. 3-4
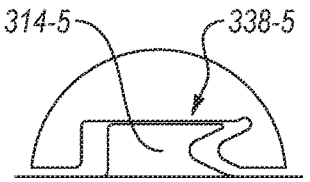
FIG. 3-5
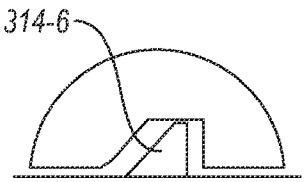
FIG. 3-6
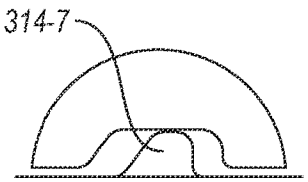
FIG. 3-7
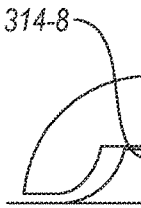
FIG. 3-8
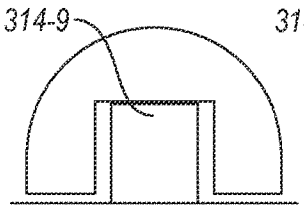
FIG. 3-9
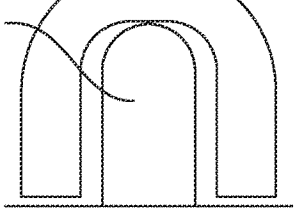
FIG. 3-10
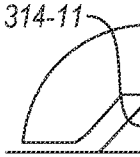
FIG. 3-11
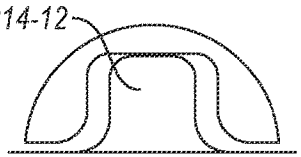
FIG. 3-12
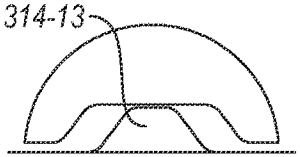
FIG. 3-13

DEVICES AND SYSTEMS FOR DISPLACEMENT CONTROL IN SEISMIC BRACES AND YIELDING LINKS

CROSS-REFERENCE TO RELATED APPLICATIONS

N/A.

BACKGROUND

Buildings and other structures are often designed to primarily withstand loads oriented with respect to gravity but must also include load path systems to transfer loads that may occur orthogonal to gravity loading. Non-gravity loads primarily considered are from wind and seismic events and soil or hydraulic retainage forces but may also include loading from impulse events such as blast loading.

For loads of lower probability and higher magnitude, such as those from earthquakes and blast loading, it is possible to design a lateral force-resisting system that includes fuse-like elements in the structure to absorb the energy of the event and limit the maximum load to be transferred to the rest of the structural elements in that force-resisting system. This fuse-like element is often a steel product and is designed to yield in the event and thereby limit transferred forces. This protects the rest of the elements in the load path from failure due to excessive loading given those elements have been designed to be stronger than the maximum strength of the steel yielding element. The steel yielding element can be configured in such a manner as to yield axially in tension, by bending, through axial compression buckling, or in an axial condition where buckling of the steel is constrained in such a manner as to achieve axial yielding of the steel element in both tension and compression.

Fracture of the steel yielding element in the lateral force-resisting system of building or structure disrupts the load path and therefore could result in instability of the structure or collapse. In an optimally designed steel yielding element, fracture occurs primarily due to excessive elongation of a portion of the yielding element. During the tensile yielding process in steel, the strain in the material eventually localizes in a small region, leading to a significant reduction in the cross-sectional area and increase in localized strains of the material known as "necking" and results in fracture of the material. In yielding elements that yield axially in compression, yielding tends to occur in a localized region with an increase or "bulge" in cross sectional area. For axial yielding elements experiencing alternating tensile and compressive loading, a "ratcheting" type effect occurs wherein the tension yielding occurs repeatedly in the localized "necking" region and the compression yielding occurs repeatedly in the localized "bulging" region of the yielding length. This localized increase in strains occurs even when the overall yielding length of the material is longer and leads to fracture of the yielding element at average strains well below the expected tensile fracture elongation of the material.

BRIEF SUMMARY

In some embodiments, a seismic brace includes a yielding element including a displacement control element that extends from the yielding element. The displacement control element is inserted into a displacement zone of a displacement restraint. During deformation, the displacement control element moves within the displacement zone until it contacts the displacement restraint. This causes the load to be transferred to a different portion of the yielding element. In some embodiments, the yielding element includes a plurality of displacement control elements.

This summary is provided to introduce a selection of concepts that are further described below in the detailed description. This summary is not intended to identify key or essential features of the claimed subject matter, nor is it intended to be used as an aid in limiting the scope of the claimed subject matter.

Additional features and advantages of embodiments of the disclosure will be set forth in the description which follows, and in part will be obvious from the description, or may be learned by the practice of such embodiments. The features and advantages of such embodiments may be realized and obtained by means of the instruments and combinations particularly pointed out in the appended claims. These and other features will become more fully apparent from the following description and appended claims, or may be learned by the practice of such embodiments as set forth hereinafter.

BRIEF DESCRIPTION OF THE DRAWINGS

In order to describe the manner in which the above-recited and other features of the disclosure can be obtained, a more particular description will be rendered by reference to specific implementations thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example implementations, the implementations will be described and explained with additional specificity and detail through the use of the accompanying drawings in which:

FIG. 1-2 is a representation of an exploded view of another seismic brace, according to at least one embodiment of the present disclosure;

FIG. 2-1 is a representation of a top-down view of a seismic brace, according to at least one embodiment of the present disclosure;

FIG. 2-2 is a representation of a side view of the displacement zone of FIG. 2-1;

FIG. 2-3 and FIG. 2-4 are representations of the displacement zone of FIG. 2-1 in deformed positions;

FIG. 3-1 through FIG. 3-16 are representations of displacement zones having various geometries of displacement control elements, according to at least one embodiment of the present disclosure;

FIG. 4 is a representation of a top down view of another seismic brace, according to at least one embodiment of the present disclosure;

FIG. 5 is a representation of a side view of another seismic brace, according to at least one embodiment of the present disclosure;

FIG. 6 is a representation of a top down view of another seismic brace, according to at least one embodiment of the present disclosure;

FIG. 7 is a representation of a top down view of another seismic brace, according to at least one embodiment of the present disclosure;

FIG. 8 is a representation of a side view of another seismic brace, according to at least one embodiment of the present disclosure;

FIG. 9 is a representation of a side view of another seismic brace, according to at least one embodiment of the present disclosure;

FIG. 10 is a representation of a top down view of another seismic brace, according to at least one embodiment of the present disclosure;

FIG. 11 is a representation of a side view of another seismic brace, according to at least one embodiment of the present disclosure;

FIG. 12-1 and FIG. 12-2 are representations of a top down view of another seismic brace, according to at least one embodiment of the present disclosure;

FIG. 13 is a representation of a side view of an end transfer segment, according to at least one embodiment of the present disclosure;

FIG. 14 is a representation of a side view of another end transfer segment, according to at least one embodiment of the present disclosure;

FIG. 15-1 and FIG. 15-2 are representations of another end transfer segment, according to at least one embodiment of the present disclosure;

FIG. 16-1 and FIG. 16-2 are representations of another end transfer segment, according to at least one embodiment of the present disclosure;

FIG. 17-1 and FIG. 17-2 are representations of a link displacement system, according to at least one embodiment of the present disclosure.

DETAILED DESCRIPTION

Figure 1:
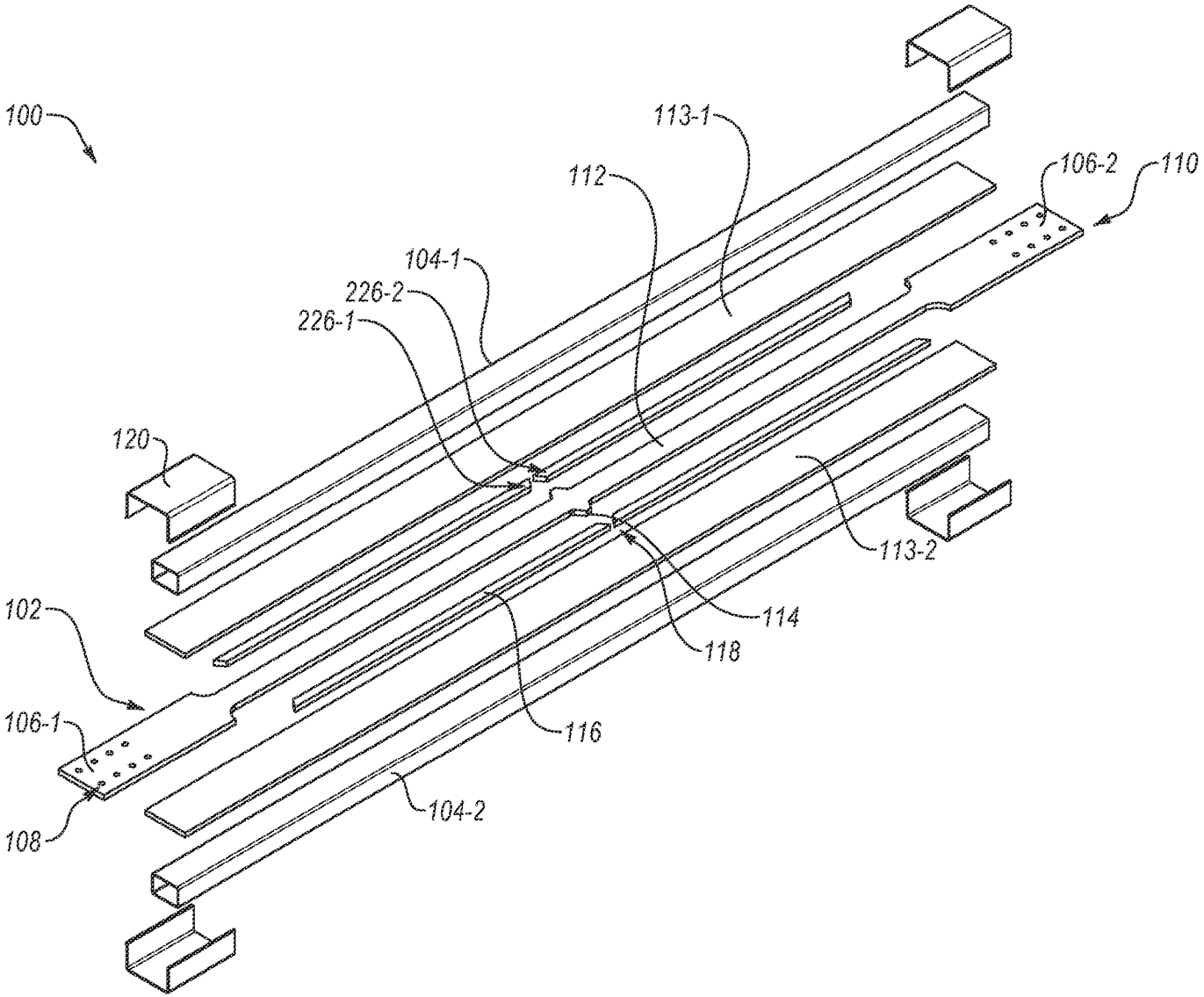
FIG. 1-1 is a representation of an exploded view of a seismic brace, according to at least one embodiment of the present disclosure.

This disclosure generally relates to devices, systems, and methods for increasing the effectiveness of structural seismic braces when subjected to yielding loads. A seismic brace includes a yielding member. When subjected to seismic loads, the yielding member may deform in compression and/or tension. A displacement control element may be connected to the yielding member. During deformation of the seismic brace, the displacement control element may contact a displacement restraint. Contact of the displacement control element with the displacement restraint may help to transfer the seismic load to another portion of the yielding element.

In accordance with embodiments of the present disclosure, displacement control devices may be used in yielding elements that are part of buckling-restrained braces, yielding steel links, steel moment connections, or in other elements utilizing intentional yielding of steel to limit transferred forces. The displacement control mechanism may be implemented to limit the overall or global elongation of the yielding element and engage only at displacements anticipated to cause fracture. The displacement control mechanism may also be employed to limit the elongation of local segments of the yielding element and thus reduce localized "necking" effects, forcing other yielding segments of the element to contribute more evenly to elongation demands. Additionally, items that are generally used to rigidly fix the yielding element in place, such as the stopper used in a buckling restrained brace, are permitted limited movement to allow for sharing of inelastic demands across the entire yielding length.

The present disclosure includes a number of practical applications that provide benefits and/or solve problems associated with seismic supports and braces. For example, as will be discussed in further detail herein, seismic braces described herein may increase the amount of seismic energy absorbed by the yielding element before global failure. This may result in an increased effectiveness of the seismic brace.

In another example, as will be described further herein, a seismic brace may include multiple displacement control elements along a length of the yielding element. Under seismic loading, the yielding element may experience localized deformation (either compressive or tensile deformation) at a first location. As the yielding element deforms, the closest displacement control element(s) may move relative to the displacement restraint. When the displacement control element(s) contact the displacement restraint, further deformation of the yielding element may be reduced or prevented in the first location. This may result in at least a portion of the seismic load being transferred to a second location of the yielding element. Further seismic loading may result in localized deformation of the yielding element at the second location. In this manner, including multiple displacement control elements may cause the yielding element to experience localized deformation in multiple locations. Increasing the number of locations that experience localized deformation may increase the amount of energy absorbed by the seismic brace, thereby increasing its effectiveness.

In another example, as will be described further herein, a seismic brace may include one or more displacement control elements at an end transfer segment. The end transfer segment may be the portion of the seismic brace that connects to the rest of the structure. As the structure experiences seismic loading, the seismic load may be transferred to the seismic brace through the end transfer segment. A displacement control element included at one or both end transfer segments may allow the end transfer segments to experience deformation while limiting that deformation to not exceed the anticipated yielding element fracture displacement. In this manner, the seismic brace may continue to receive seismic loading from the structure for a longer duration.

Furthermore, as will be discussed further herein, seismic braces according to the present disclosure may continue to absorb seismic loads even after a portion of the yielding element has fractured due to local deformation. For example, after local deformation of the yielding element leads to fracture, one or more of the displacement control elements may contact the displacement restraint. The contact with the displacement restraint may provide further support for the yielding element under seismic loads. This may allow seismic braces of the present disclosure to continue to absorb seismic energy even after a portion of the yielding element has fractured.

As used herein, a seismic load may be any variable load applied to a structure, such as the variable shaking load applied to a structure during a seismic event (e.g., an earthquake). While embodiments of the present disclosure may discuss seismic loads as related to a seismic event, it should be understood that "seismic loads" as discussed herein may include any load that has been determined to be beneficial to resolve through the use of a yielding element. In some embodiments, a seismic load may include a variable load. In some embodiments, a seismic load may include a load that is not a result of the constant force of gravity. In some embodiments, a seismic load may include loads induced by the failure of adjacent structures or portions of structures, such as in a progressive collapse situation. Thus, inferred loads, seismic loads, variable loads, and combinations thereof may be the result of wind, transportation of people, vehicles, or goods through a structure, water travel, blast or impulse events, any other variable load, and combinations thereof. In some situations, the load may vary in direction and force. For example, the load may exhibit oscillating loads that change direction (e.g., up and down, left to right, front to back, and combinations thereof) and/or force sign.

As used herein, a brace or a seismic brace provides support for a structure during seismic loading. In some embodiments, seismic loading may introduce one or more of increased loading parallel to the force of gravity, loading transverse to the force of gravity, or loading perpendicular to the force of gravity. In a building, a seismic brace is often placed diagonally relative to the primarily vertical columns and horizontal beams. A brace may include one or more elements that are designed to intentionally deform plastically due to the applied loading. This plastic deformation may act as a fuse-type element, protecting other elements from overloading by limiting the transferred force. It also may help to absorb the energy on the structure due to the seismic loading.

As used herein, a yielding element is a portion of a seismic brace that is designed to intentionally deform when a certain load is applied. In some embodiments, the deformation of the yielding element may be a result of compressive loading (e.g., two opposing forces pushing two ends of the yielding element toward each other). In some embodiments, the deformation of the yielding element may be a result of tensile loading (e.g., two opposing forces pulling two ends of the yielding element apart from each other). In some embodiments, the yielding element may be deformable based on a difference in material moduli relative to the rest of the structure. In some embodiments, the yielding element may be designed to yield based on a decreased cross-sectional area of a portion of the yielding element. In some embodiments, the yielding element may be deformable in specific deformation zones. For example, the yielding element may be deformable between two displacement control elements, between an end transfer segment and a displacement control element, between a displacement control element and a fixed stopper, or anywhere else.

As used herein, a displacement control element is any portion of or any element connected to the yielding element that may limit the deformation of the yielding element. For example, a displacement control element may be a protrusion extending from the yielding element. In some examples, a displacement control element may be a separate element that is subsequently attached (e.g., welded, bolted, screwed, brazed) to the yielding element. In some embodiments, as the yielding element deforms, the displacement control element may move relative to a displacement restraint of the seismic brace. After the displacement control element moves a displacement amount, the displacement control element may contact the displacement restraint, thereby limiting or prevent further deformation. Thus, a displacement control element may be any element that interacts with the displacement restraint to prevent or limit deformation of the yielding element.

As used herein, a displacement restraint is any portion of the seismic brace that engages with a portion of the yielding element (e.g., with a displacement control element) to prevent or reduce deformation of the yielding element. In some embodiments, the displacement restraint may be fixed relative to the yielding element or at least a portion of the yielding element. Thus, the yielding element may deform without the displacement restraint moving or deforming.

FIG. 1-1 is a representation of an exploded view of a seismic brace 100, according to at least one embodiment of the present disclosure. The seismic brace 100 includes a yielding element 102 located between two spines (collectively 104), including a first spine 104-1 and a second spine 104-2. The spines 104 may be hollow sections or they may also be C-shaped sections, L-shaped sections, plate sections, or other bent plate or built-up configurations. The yielding element 102 includes two end transfer segments (collectively 106), including a first end transfer segment 106-1 located at a first end 108 of the seismic brace 100 and a second end transfer segment 106-2 located at a second end 110 of the seismic brace 100. The first end transfer segment 106-1 may be located opposite the second end transfer segment 106-2 on the yielding element 102.

A yielding section 112 may be located between the first end transfer segment 106-1 and the second end transfer segment 106-2. The yielding section 112 may have a lower strength than the end transfer segments 106. For example, in the embodiment shown in FIG. 1, the yielding section 112 has a yielding width that is less than a transfer width of one or both of the end transfer segments 106. When a tensile load is applied to the yielding element 102 (e.g., a load that urges the first end transfer segment 106-1 and the second end transfer segment 106-2 further away from each other), the yielding section 112 may deform by elongation (e.g., get longer and thinner) between the end transfer segments 106. When a compressive load is applied to the yielding element 102 (e.g., a load that urges the first end transfer segment 106-1 and the second end transfer segment 106-2 closer to each other), the yielding section 112 may deform by buckling or compression. In some embodiments, the yielding section 112 may be specifically designed to deform under a tensile or compressive load before one or both of the end transfer segments 106. In some embodiments, intentional deformation of the yielding section 112 may help to preserve the integrity of the connected structure by absorbing seismic energy, limiting the magnitude of transferred forces, and/or reducing relative motion between two elements of the connected structure.

In some embodiments, the seismic brace 100 may include one or more face restraints 113. A face restraint 113 may be located between a spine 104 and the yielding element 102. In some embodiments, the face restraint 113 may be offset from the yielding element 102 by a small amount. This offset may be uniform or may intentionally vary throughout the length of the yielding element. The face restraint 113 may allow the yielding element 102 to deform under seismic loads. In some embodiments, the face restraint 113 may help to control the deformation of the yielding element 102.

In some embodiments, the seismic brace 100 may include one or more side restraints 116. A side restraint 116 may be located between a spine elements (collectively 104) and to either side of the yielding element 102. In some embodiments, the side restraint 116 may be offset from the yielding element 102 by a small amount. This offset may be uniform or may intentionally vary throughout the length of the yielding element. The side restraint 116 may allow the yielding element 102 to deform under seismic loads. In some embodiments, the side restraint 116 may help to control the deformation of the yielding element 102. In some embodiments, the side restraint 116 may be fixed to one or both of the first spine 104-1 and the second spine 104-2. In some embodiments, the side restraint 116 may be fixed to one or both of the first face restraint 113-1 and the second face restraint 113-2.

The yielding element 102 may include a displacement control element 114. In some embodiments, the displacement control element 114 may include a stopper that is rigidly connected to the face restraint 113 and/or the side restraint 116. In the embodiment shown, the displacement control element 114 is shown in the center of the yielding element 102 on the yielding section 112. However, it should be understood that the displacement control element 114 or stopper may be located anywhere along the length of the yielding section 112. In some embodiments, yielding element 102 may include a plurality of displacement control elements 114. In some embodiments, the displacement control or stopper element 114 is located within a displacement zone 118. The displacement zone 118 is located between displacement restraints, 126-1 and 126-2, on either side of the displacement control/stopper element 114. In the embodiment shown, the displacement zone 118 is formed between side restraints 116 and the side restraints act as the displacement restraints 126. The displacement restraint 126 may be fixed in position relative to the yielding element 102. Put another way, when a portion of the yielding element 102 deforms, the yielding element 102 may move relative to the displacement restraint 126. In some embodiments, the displacement restraint 126 may be formed from or affixed to one or both of the first spine 104-1 and/or the second spine 104-2. In some embodiments, the displacement zone 118 may be formed from or affixed to one or both of the first face restraint 113-1 and the second face restraint 113-2. The element(s) used to form or create the displacement zone 118 are hereafter referred to collectively as the displacement restraint 126.

The brace 100 may include one or more displacement zones 118. In some embodiments, a displacement zone 118 may be a change in the width of the displacement restraint 126. In some embodiments, the displacement restraint 126 may include a plurality of segments, and the displacement zone 118 may be the space between two segments of the displacement restraint 126. In some embodiments, the displacement control element 114 may be inserted into or located in the displacement zone 118. When a portion of the yielding element 102 deforms, the displacement control element 114 may move relative to the displacement restraint 126. The displacement control element 114 may move within the displacement zone 118 until the displacement control element 114 contacts the displacement restraint 126. Contact of the displacement control element 114 with the displacement restraint 126 may prevent further translation of the yielding element 102. In some embodiments, contact of the displacement control element 114 may transfer the deformation load to a different portion of the yielding element 102. This may allow a different portion of the yielding element 102 to deform, thereby increasing the ability of the yielding element 102 to deflect and absorb energy.

In the embodiment shown, the seismic brace 100 includes four alignment caps 120. The alignment caps 120 may extend over the spines 104 to align the spines 104 over the yielding element 102 at the end transfer segments 106, connecting to end transfer segments 106.

Figures 1, 2:
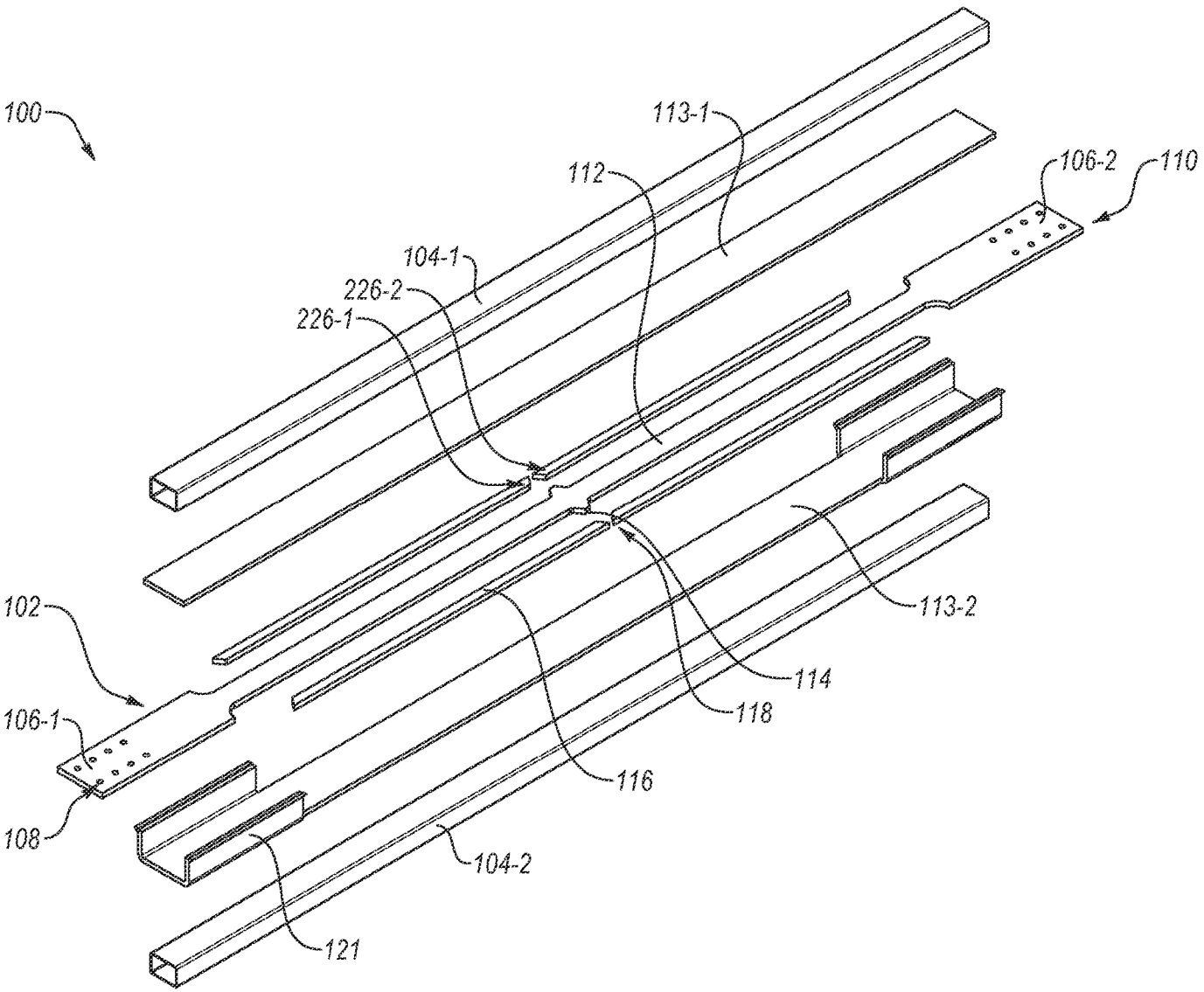

FIG. 1-2 is a representation of an exploded view of the seismic brace 100 of FIG. 1-1 having one or more alignment plates 121. The alignment plates 121 may be connected to the end segments 106. For example, the alignment plates 121 may extend transverse or perpendicular to the end segments 106. The alignment plates 121 may help to align the face restraint 113 and/or the spine 104 over the yielding element 102.

FIG. 2-1 is a representation of a top-down view of a seismic brace 200, according to at least one embodiment of the present disclosure. The seismic brace 200 includes a yielding element 202. In the view shown, the yielding element 202 extends with a yielding element length 222 from a first end transfer segment 206-1 to a second end transfer segment 206-2. The yielding element 202 includes a yielding section 212 which extends with yielding section width 224 from an interior side of 216-2 to an interior side of 216-3. The yielding section 212 further extends with a yielding section length 228 between the first end transfer segment 206-1 and the second end transfer segment 206-2. The yielding section 212 further extends a yielding section thickness into the page shown (see yielding section thickness 230 of FIG. 2-2). In some embodiments, the yielding section width 224 is greater than the yielding section thickness 230.

As may be seen the yielding section width 224 may be smaller than an end transfer width 232 of the end transfer segments (collectively 206). Furthermore, the yielding section thickness may be constant along the yielding element length 222. In some embodiments, the yielding section width 224 may be the same as the transfer width 232 and the thickness of the transfer segments may be increased. Because the yielding section area at 224 is less than the end transfer area at 232, when a load is applied to the yielding element 202, the yielding section 212 may yield before the end transfer segments 206. In some embodiments, the yielding strength of the end segment steel may be greater than the yielding section steel yet have similar cross-sectional areas, again permitting yielding at the yielding section 212 but limiting yielding at the end segments 206. For example, when a compressive force 234 is applied to the seismic brace 200 through the end transfer segments 206 (e.g., a load that urges the end transfer segments 206 toward each other), the yielding section 212 may deform by bulging and/or small-amplitude buckling before the end transfer segments 206 yield. In another example, when a tensile force 236 is applied to the seismic brace 200 through the end transfer segments 206 (e.g., a load that urges the end transfer segments away from each other), the yielding section 212 may deform by thinning in the yielding section width 224 and/or the yielding section thickness and extending in the yielding section length 228. In this manner, the yielding element 202 may absorb energy and limit transferred force magnitude through controlled yielding while remaining connected to the remainder of the structure.

The yielding section 212 has one or more displacement control elements 214. For example, in the embodiment shown, the yielding section 212 includes a displacement control element 214-1 near the second end of 226-1 and the first end of 226-2. Furthermore, in the embodiment shown, the displacement control elements 214-1 are located near the center of the yielding section 212 (e.g., halfway between the first end transfer segment 206-1 and the second end transfer segment 206-2).

As used herein, the yielding section plane is the plane that is parallel to both the yielding section length 228 and the yielding section width 224. Put another way, the yielding section plane is the plane that is parallel to the two largest dimensions of length, width, and thickness. In the embodiment shown in FIG. 2-1, a displacement control element 214-1 may extend from the yielding section 212 in the same plane as the yielding section 212, or in the yielding section plane. Put another way, the displacement control element 214-1 extends parallel to the plane of the yielding section 212, or the yielding section plane.

In some embodiments, the displacement control element 214-1 may be formed as a portion of the yielding element 202. For example, the displacement control element 214-1 may be cut from the same steel plate as the yielding element 202 without welding or otherwise attaching the displacement control element 214-1 to the yielding element 202. In some embodiments, the displacement control element 214-1 may be formed separately from the yielding element 202 and subsequently attached. For example, the displacement control element may be attached to the yielding element by welding, mechanical fastener, brazing, any other connection mechanism, and combinations thereof. In some embodiments, the displacement control element 214-1 may be formed from any element of the brace and may be removed from the yielding element 212.

The seismic brace 200 may further include one or more displacement restraints (collectively 226). In some embodiments, the displacement restraints 226 may help to restrict, limit, or otherwise control deformation of the yielding section 212. For example, in the embodiment shown, a first displacement restraint 226-1 may be located on a first side of the displacement control element 214-1 (e.g., between the displacement control element 214-1 and the first end transfer segment 206-1), and a second displacement restraint 226-2 may be located on a second side of the displacement control element 214-1 (e.g., between the displacement control element 214-1 and the second end transfer segment 206-2). In the embodiment shown, the displacement control restraints 226 are part of the side restraints 216 and are steel plates that extends parallel to the yielding section plane of the yielding section 212. However, it should be understood that the displacement control restraints 226 may be located in any location and formed from any part that interacts with the displacement control device 214-1. For example, the displacement control restraints 226 may be a steel plate that is oriented transverse or perpendicular to the yielding section plane. In some embodiments, as discussed herein, the displacement control restraints 226 may be a flowable material, such as concrete, grout, polymer composite, or other flowable material.

The displacement control element 214-1 may be located in a displacement zone 238 of the displacement restraint 226. In the embodiment shown, two separate side restraints 216-1 and 216-2 are used for displacement restraints 226 and the displacement zone 238 is located between the first displacement restraint 226-1 and the second displacement restraint 226-2. However, as will be discussed in greater detail herein, the displacement zone 238 may be a part of an indentation, hollow, opening, or other space in a continuous displacement restraint 226.

The displacement zone 238 can be configured either to permit movement or not permit movement of the displacement control device 214-1 within the displacement zone 238. If the displacement zone 238 is of minimal size and permits little or no movement of the displacement control device 214-1, element 214-1 is defined as a stopper. During deformation of the yielding section 212, the displacement control element 214-1 may move within the displacement zone 238. When the displacement control element 214-1 has moved sufficiently to contact the displacement restraint 226, the displacement restraint 226 may prevent further movement of the displacement control element 214-1. In some embodiments, this contact may prevent further deformation of the yielding section 212 at one or more yielding zones. In some embodiments, this contact may transfer loading or deformation to a different portion of the yielding section 212. Transferring the loading or deformation to a different portion of the yielding section 212 may better distribute the ductility demand along the entire length of the yielding section 212 and thus may increase the total amount of deformation experienced and/or energy absorbed by the yielding section overall length 228. Alternately, if bulging of the yielding element or other unintentional interlocking has restricted free movement of the yielding core 212 with respect to the side restraints 216, the face restraints 113, or the spines 104, ductility demand along the length of the core can continue to be better distributed.

In accordance with embodiments of the present disclosure, a yielding section 212 may include a first deformation zone 240-1 and a second deformation zone 240-2. When experiencing a deformation load (e.g., a load that is large enough to cause deformation of the yielding section 212), the yielding section may begin deforming in the first deformation zone 240-1 or the second deformation zone 240-2. For example, when a compressive force 234 is applied to the yielding element 202, the yielding element 202 may begin to deform by bulging and/or small-amplitude buckling in the first deformation zone 240-1.

Small variations in side restraints 216 or face restraints (see 213 of FIG. 2-2) may induce greater friction at one end of the yielding element versus the other end of the element. Additionally, yielding element bulging or small-amplitude buckling may create transient increased friction of between the yielding element 212 and the face restraints 213 or side restraints 216. For example, slightly greater friction near end segment 206-2 between elements 216-2 and 216-3 and the yielding element 212 may reduce the deformation of deformation zone 240-2 by limiting the movement of end 206-2 to the left and thus increase the deformation demand on deformation zone 240-1. Because the center element used is a displacement control device rather than a rigidly located stopper element, deformation zone 240-2 can still deform by moving displacement control device 214-1 towards displacement restraint 226-2 even if movement at end segment 206-2 is periodically constrained by friction or other transient force. This enables greater deformation and inelastic demand sharing of both segments 240 compared to a rigidly affixed stopper element (see 654 of FIG. 6).

With continued application of compression load 234 and the greater friction near end 206-2, displacement zones 240-1 and 240-2 continue to shorten axially, with most movement coming from end 206-1 moving towards displacement restraint 226-2. After the displacement control element 214-1 has moved a displacement distance 242 (see FIG. 2-2), it may contact displacement restraint 226-2 (similar to placement shown in FIG. 2-4). Because the second displacement restraint 226-2 is fixed relative to the yielding section 212, contact of the displacement control element 214-1 with the second displacement restraint 216-2 may prevent the displacement control element 214-1 from moving closer to the second displacement restraint 226-2.

After the first displacement restraint 226-2 prevents further deformation or displacement of the yielding section 212 in the second deformation zone 240-2, the compressive force 234 may continue to be applied to the yielding element 202 in first deformation zone 240-1. The overall inelastic compressive demand on the yielding element 212 may be reduced because the additional displacement 242 has been transferred to the second deformation zone 240-2 rather than imposing the entire deformation onto deformation zone 240-1. This may increase the energy absorption capacity of the yielding element 202.

Following the compressive cycle 234 may be a tensile cycle 236, wherein the yielding section 212 is still compressed and the unintentional interlocking near end 206-2 is still present. At the beginning of the cycle, most movement of the end regions 206 occurs with end segment 206-1 moving away from displacement restraint 226-2. The tensile displacement demand 236 along the yielding element 212 is still shared between deformation zones 240-1 and 240-2 because displacement control device 214-1 is permitted to move towards displacement restraint 226-1 a distance of 242+244 (see FIG. 2-2). If the unintentional interlocking near end 206-2 does not disengage, deformation zone 240-2 may still participate in absorbing inelastic demands until displacement control device 214-1 contacts displacement restraint 226-1.

In some embodiments, an end of the side restraint 216 may be offset from the end transfer segment 206 with a restraint offset 258. Offsetting the displacement restraint with the restraint offset 258 may provide room for the yielding section 212 to deform without the end transfer segment 206 contacting the displacement restraint 216. This may allow the yielding section 212 to deform as designed, without the displacement restraint 216 and the end transfer segment 206 preventing motion of the yielding section 212. In some embodiments, the restraint offset 258 may be the same as the compressive displacement distance 242 (see FIG. 2-2) of the nearest displacement zone 238. In some embodiments, the restraint offset 258 may be greater than the displacement distance of the nearest displacement zone 238. In some embodiments, contact of the side restraint 216 with the end transfer segment 206 may prevent further displacement or deformation of the yielding section 212, making the end transfer section 206 act as a displacement control element for compression displacement 234 only. In some embodiments, the permitted tensile displacement distance 244 is designed to limit the maximum restraint offset after displacement offset (258+244) to ensure stability in that section in compression.

FIG. 2-2 is a representation of a side view of the displacement zone 238 between the first displacement restraint 216-1 and the second displacement restraint 216-2 of the seismic brace 200 of FIG. 2-1. As may be seen, the displacement control element 214-1 is located within the displacement zone 238 between the displacement restraints 216. In the embodiment shown, the seismic brace 200 includes a first face restraint 213-1 and a second face restraint 213-2. The first face restraint 213-1 may be located above a top surface of the yielding element (e.g., the yielding element 202 of FIG. 2-1) and the second face restraint 213-2 may be located below a bottom surface of the yielding element. The face restraints (collectively 213) may help to control and extend the deformation at a localized deformation zone.

A first spine 204-1 may be located above the first face restraint 213-1 and a second spine 204-2 may be located below the second face restraint 213-2. The spines (collectively 204) may be rigidly connected to the face restraints 213, the side restraints (collectively 216), and/or the displacement restraints (collectively 226). The spines 204 may help to provide rigidity for the seismic brace 200. Furthermore, the spines 204 may help to provide strength for the face restraints 213 and/or the side restraints 216 when they restrain deformation of the yielding element.

The displacement zone 238 may be wider than the displacement control element 214-1. The displacement control element 214-1 may move within the displacement zone with a displacement distance 242 or 244. The displacement distance 242 or 244 may be the distance between the displacement control element 214-1 and the displacement restraints 226. Put another way, the displacement distance 244 may be the distance that the displacement control element 214-1 may travel before it contacts the first displacement restraint 216-1.

In some embodiments, the displacement distance 244 and the yielding section length 228 may form a strain ratio, which may be the displacement distance 244 divided by the yielding section length 228. The strain ratio may be in a range having an upper value, a lower value, or upper and lower values including any of 0.1%, 0.5%, 1.0%, 2.5%, 5.0%, 10%, 15%, 20%, 25%, 30%, 35%, 40%, or any value therebetween. For example, the strain ratio may be greater than 0.1%. In another example, the strain ratio may be less than 40%. In yet other examples, the strain ratio may be any value in a range between 0.1% and 50%. In some embodiments, it may be critical that the strain ratio is greater than 0.5 to provide sufficient room for displacement of the yielding element.

In some embodiments, the displacement distance 244 between the displacement control element 214-1 and the first displacement restraint 216-1 may be the same as displacement distance 242 between the displacement control element 214-1 and the second displacement restraint 216-2. In some embodiments, the displacement distance 244 may be different from the displacement distance 242. At each displacement control device 214, displacement distances 242 and 244 may differ from other displacement control device locations.

Figures 1, 2:
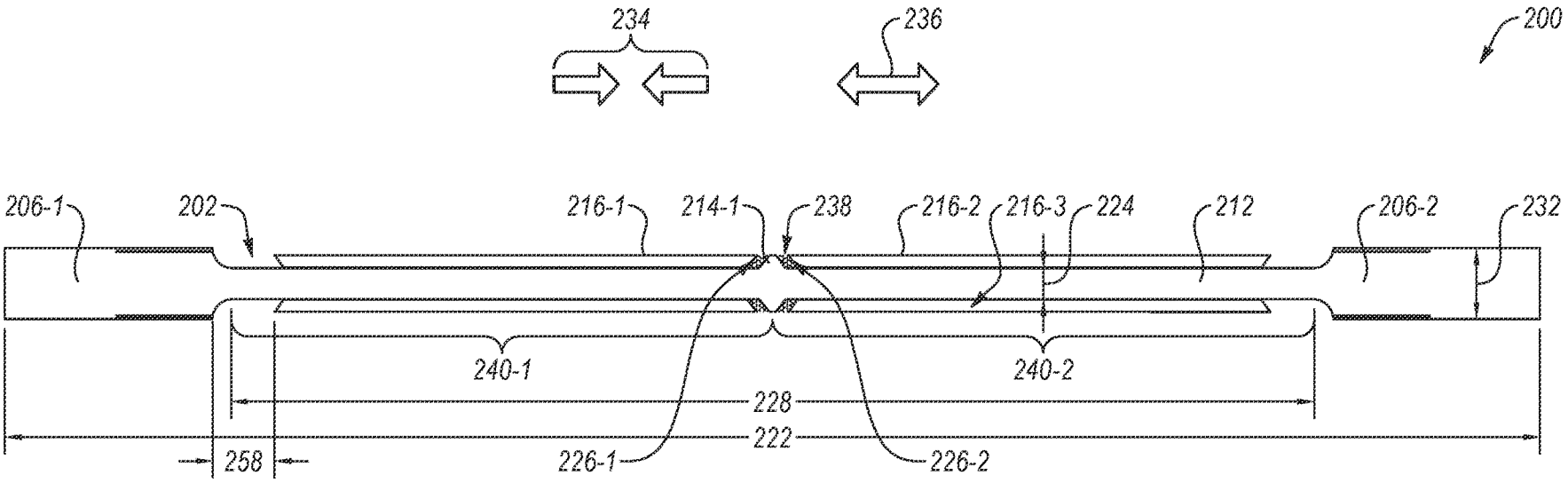
Figure 2:
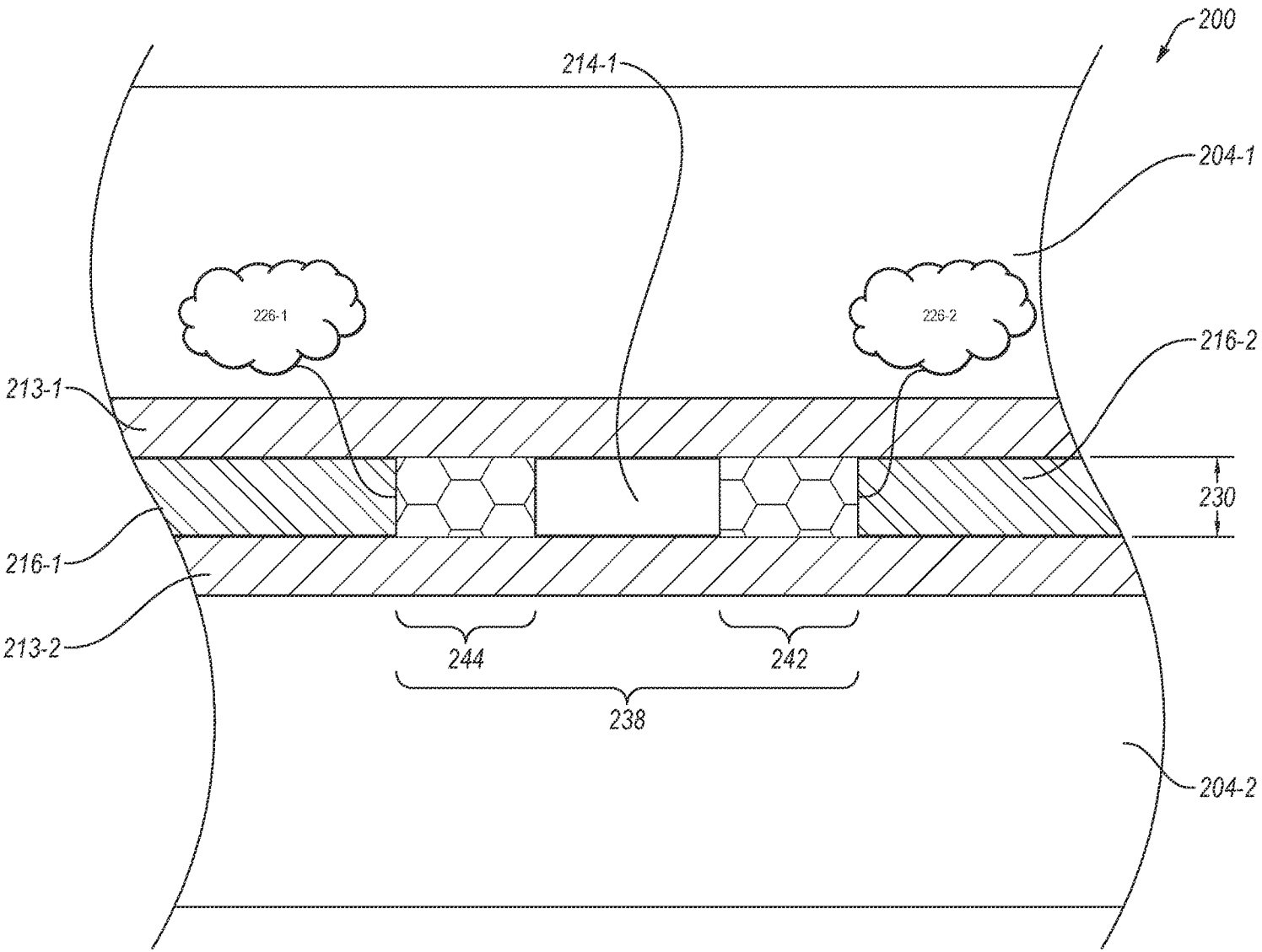
Figures 2, 3, 4:
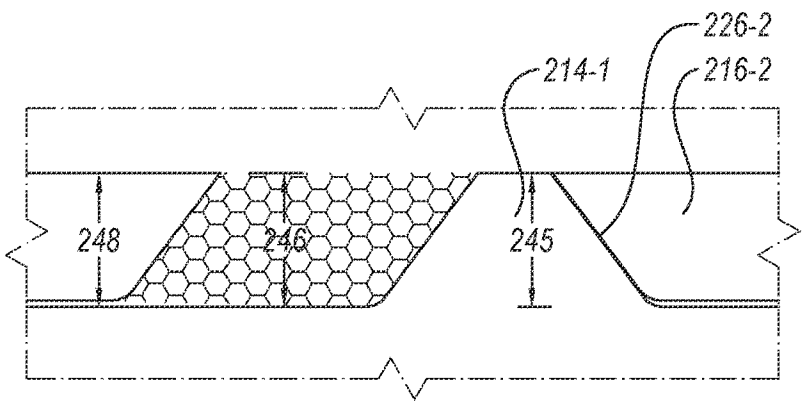
Figures 2, 3:
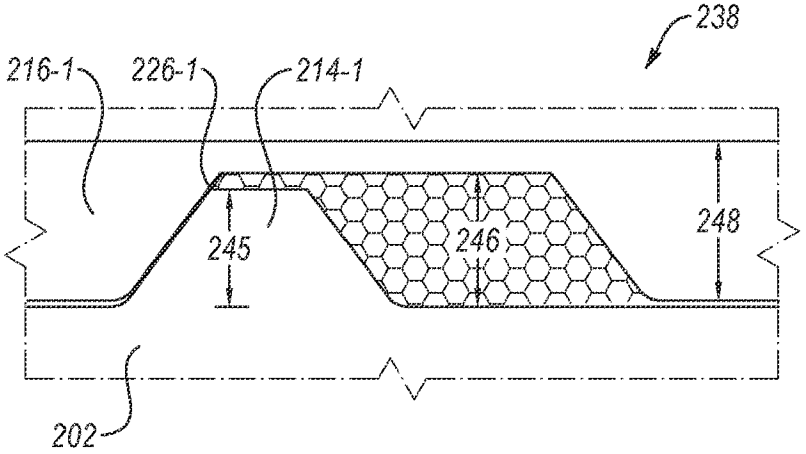

The displacement control element 214-1 has a control element width 245 (see FIGS. 2-3 and 2-4). The displacement zone 238 has a displacement zone width 246 (see FIGS. 2-3 and 2-4). In some embodiments, the displacement zone width 246 may be greater than the displacement control element width 245.

In some embodiments, the displacement zone 238 may be filled with a gaseous material. For example, the displacement zone 238 may be filled with air, or with any other gaseous material. In some embodiments, the displacement zone 238 may be filled with a pliant material, such as a polymer, rubber, or other pliant material. In some embodiments, the displacement zone 238 may be filled with a damping material, such as a viscous, friction, or other damping material. In some embodiments, the damping material may include a variable force transfer mechanism, such as a spring or compressible material within the displacement zone 238. The material in the displacement zone 238 may be designed to help control the displacement of the yielding element. It may also be designed to slow any impact that may occur when the displacement control element 214 makes contact with the displacement restraint 216. Alternately, it may increase the damping of the overall element or provide self-centering properties to the brace.

FIG. 2-3 and FIG. 2-4 are representations of a top down view of the displacement zone 238 of the seismic brace 200 of FIG. 2-1. In the view shown in FIG. 2-3, the displacement control element 214-1 is in contact with the first displacement restraint 226-1. In the view shown in FIG. 2-4, the displacement control element 214-1 is in contact with the second displacement restraint 226-2. Contact of the displacement control element 214-1 may prevent further displacement of the yielding element 202, either globally or locally. While examples here may discuss contact of the displacement control element 214-1 with either the first displacement restraint 226-1 or the second displacement restraint 226-2 with respect to deformation resulting from a compressive or a tensile force, it should be understood that the displacement control element 214-1 may contact the first displacement restraint 226-1 based on deformation resulting from either a compressive or a tensile force. Similarly, it should be understood that the displacement control element 214-1 may contact the second displacement restraint 226-2 based on deformation resulting from either a compressive or a tensile force. This is dependent on the location of the displacement control device 214-1 and the overall configuration of the final product. Additionally, it should be understood that the displacement control element may contact the material in displacement zone 238 which, in turn, makes contact with the displacement restraint, transferring the required restraint force and arresting displacement in the same manner as direct contact between the displacement control device 214-1 and the displacement restraint 226.

As may be seen, the displacement control element 214-1 and the displacement restraint 226 shown have complementary profiles. This may help to improve the contact of the displacement control element 214-1 with the displacement restraint 226. However, in some embodiments, the displacement control element 214-1 may have a dissimilar shape to the displacement restraint 226.

In the embodiment shown in FIG. 2-4, the displacement control element width 245 extends an entirety of a displacement zone width 246. Furthermore, the displacement zone width 246 may extend across an entirety of a displacement restraint width 248. Put another way, the displacement zone width 246 may be the same as the displacement restraint width 248. In this manner, the displacement restraint 226 may be split into two pieces, the first displacement restraint 226-1 and the second displacement restraint. In some embodiments, the displacement zone width 246 may be less than the displacement restraint width 248 (See FIG. 2-3). The displacement restraint 226 may thus be continuous between the first displacement restraint and the second displacement restraint. In some embodiments, the displacement zone 238 may be a hole or a slot in the displacement restraint 226, and the displacement control element 214-1 may extend into the slot.

FIG. 3-1 through FIG. 3-16 are representations of various geometries of displacement control elements (collectively 314) being inserted within various displacement control zones (collectively 338), according to embodiments of the present disclosure. While the displacement control elements 314 are shown as associated with certain displacement control zones 338, it should be understood that any of the geometries of the displacement control elements 314 described herein may be combined with any of the geometries of displacement control zones 338. It should also be understood that the geometry of the displacement control zone 338 is not limited to the examples provided in FIG. 3-1 through FIG. 3-16.

In FIG. 3-1 through FIG. 3-4, the displacement control zones 338 each have a tapered end surface (collectively 350). A tapered end surface 350 may provide increasing resistance to tensile motion of the displacement control element 314 while not restricting compressive motion prior to contact with the displacement restraint. In some embodiments, it may be desirable for a seismic brace to provide additional tension resistance to balance out compression overstrengths. By tapering the end surface 350, the resistance to deformation of the yielding element may be tailored to a specific situation.

In FIG. 3-1, the displacement control element 314-1 may be asymmetrical and the end surface 350-1 of the displacement control zone 338-1 may have a matching profile. In FIG. 3-2, the displacement control element 314-2 has a symmetrical shape, which may resemble a bell or a bell curve, and end surface 350-2 of the displacement control zone 338-2 may have a similar profile. In FIG. 3-3, the displacement control element 314-3 may be pyramidal and the end surface 350-3 of the displacement control zone 338-3 may have a similar profile.

Figures 3, 4, 5, 6, 7, 8, 9, 10, 11, 12, 13, 14:
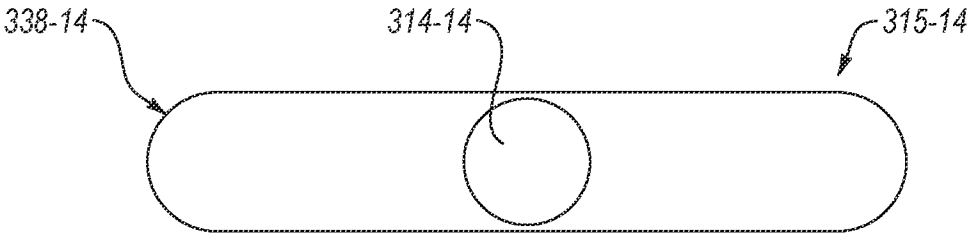

In FIG. 3-4 the displacement control element 314-4 has a convex outer edge and a rounded top. In FIG. 3-5 the displacement control element 314-5 has one straight edge. A second edge may have an interlocking element. The interlocking element may engage with a complementarily shaped surface of the displacement control zone 338-5. This engagement may add inelastic energy absorption and reduce stress concentrations at the displacement control element that could lead to yielding element fracture.

In FIG. 3-6 the displacement control element 314-6 includes one straight angled edge and a strait vertical edge with a flat top. In FIG. 3-7 the displacement control element 314-7 may be asymmetrical with straight angled edge and a strait vertical edge with a rounded top. In FIG. 3-8, the displacement control element 314-8 has a flat top with a sharp transition to curved sides. In FIG. 3-9, the displacement control element 314-9 has straight sides and top, with a sharp transition between the sides and top. In FIG. 3-10, the displacement control element 314-10 has straight sides with a semicircular top. In FIG. 3-11, the displacement control element 314-11 has a triangular or pyramidal shape. In FIG. 3-12, the displacement control element 314-12 has straight sides, a straight top, and rounded transitions between the sides and the top. In FIG. 3-13, the displacement control element 314-13 has angled straight sides with a curved top.

In FIG. 3-14 through FIG. 3-16, a displacement control element 314 is inserted into a displacement zone 338 having a slot (collectively 315). In FIG. 3-14, the displacement zone 338-14 includes a slot 315-14 that is symmetrical. Each end of the slot may have a profile that matches the size and shape of the displacement control element 314-14. In FIG. 3-15, the slot 315-15 has a tapered end 317-15. The tapered end 317-15 may approximate the shape of the displacement control element 314-15, but may reduce in size toward the end 317-15. This may increase the resistance to deformation as the displacement control element 314-15 moves into the tapered end 317-15. In FIG. 3-16, the slot 315-16 includes an elliptical end 317-16. The elliptical end may approximate the size and/or shape of the displacement control element 314-16, but may reduce in size and change in shape toward the end 317-16. This may increase the resistance to deformation as the displacement control element 314-16 moves into the elliptical end 317-16.

FIG. 4 is a representation of a top down view of a seismic brace 400 filled with a flowable material 452, according to at least one embodiment of the present disclosure. The seismic brace 400 includes a yielding element 402 having a yielding section 412. A spine 404 may surround the yielding section 412. For example, the spine 404 may be a piece of tube steel may encircle the yielding element 402 around the yielding section 412.

In some embodiments, the spine 404 may be filled with a flowable material 452. The flowable material may be any flowable or premanufactured material. For example, the flowable material may be a cementitious material, such as grout or concrete. In some examples, the flowable material may be polymer or polymer composite. It may also be a premanufactured material, such as precast concrete.

In some embodiments, the flowable material 452 may act as a displacement restraint for displacement control device 414 by engaging at points 426-1 or 426-2 in the flowable material 452 (e.g., the displacement restraint 226 as described in reference to FIG. 2-1 through FIG. 2-4). The flowable material 452 may include a displacement zone 438 around a displacement control element 414. When experiencing a compressive or a tensile load, the yielding section 412 may deform, causing the displacement control element 414 to move within the displacement zone 438. When the displacement control element 414 contacts the flowable material 452, the flowable material may help to prevent further deformation of the yielding section 412. Thus, the flowable material 452 may act as a displacement restraint, as described herein.

FIG. 5 is a representation of a side view of a seismic brace 500 filled with a flowable material 552, according to at least one embodiment of the present disclosure. The seismic brace 500 shown includes a yielding element 502 having a yielding section 512. In the view shown, the plane of the yielding section 512 is directed into and out of the page. The seismic brace 500 includes a spine 504 that extends along a length of the yielding element 502. The seismic brace 500 may be filled with a flowable material 552.

In the embodiment shown, a displacement control element 514 is connected to the yielding section 512 perpendicular to the yielding section plane. The displacement control element 514 may extend into a displacement zone 538 formed within the flowable material 552. In some embodiments, connecting the displacement control element perpendicular to the yielding section 512 may allow for a longer displacement control element 514, which may increase the strength of the contact between the displacement control element 514 and the flowable material 552. It may also assist in the centering of the yielding element 502 within the spine/casing 504.

FIG. 6 is a representation of a top view of a seismic brace 600 having multiple displacement control elements (collectively 614) spaced along a length of a yielding element 602, according to at least one embodiment of the present disclosure. Providing multiple displacement control elements 614 may increase the number of deformation zones (collectively 640). Increasing the number of deformation zones 640 provides for more consistent strain and ductility demand along the length of the yielding element 612. Shorter deformation zones 640 may reduce the risk of necking in the yielding section 612, with associated reduction of risk of fracture of the yielding element 602. This may increase the effectiveness of the seismic brace 600.

Consider brace type that omits the displacement zone, changing element into a stopper. When experiencing a load, this yielding section typically deforms locally. Put another way, when the yielding section begins deforming at a deformation location, the material of the yielding section narrows and thus loses some strength. This makes further deformation at the deformation location easier and more likely. Once deformation has begun, the yielding section may continue to deform at the deformation location until the deformation location begins to narrow and "necking" occurs. Necking increases the risk of yielding section fracture. By deforming in a single, localized location until fracture, the energy absorption capacity of the yielding element is reduced. By adding deformation limiting devices 614, the deformation that can occur in each yielding zone 640 is also limited, thus limiting the strain in each yielding zone 640 and reducing the localized strains to below the strain at which necking occurs. Therefore, the ductility demand on the yielding element 612 may be more equally distributed to all yielding zones 640.

The yielding section 612 shown includes a possible center stopper 654. The stopper 654 may be rigidly connected to a displacement restraint 616. The stopper 654 may help to further control movement between the yielding element 602 and the rest of the seismic brace 600, including the displacement restraint 616. However, in some embodiments, the stopper 654 may be replaced with a displacement control device 614 and displacement zones 638. The fixed stopper 654 may be used to create a deformation zone 640 between the fixed stopper 654 and the displacement control elements 614.

A deformation zone 640 may be located between each displacement control element 614 and/or a fixed stopper 654. Thus, in the embodiment shown, a first deformation zone 640-1 may be located between a first end transfer segment 606-1 and the first displacement control element 614-1. A second deformation zone 640-2 may be located between the first displacement control element 614-1 and the stopper 654. A third deformation zone 640-3 may be located between the stopper 654 and a second displacement control element 614-2, and a fourth deformation zone 640-4 may be located between the second displacement control element 614-2 and a second end transfer section 606-2. Including the four deformation zones 640 may help to increase the number of areas of local deformation. This may increase the total deformation experienced by the yielding element before fracturing and/or the amount of energy absorbed by the yielding element 602 during a seismic event by limiting localized strains and spreading deformation demands more equally along the yielding length 628.

In the embodiment shown, the displacement restraint 616 is continuous between the first end transfer segment 606-1 and the second end transfer segment 606-2 (See FIG. 2-3). The displacement control elements 614 do not extend across an entirety of the width of the displacement restraint 616. To form the first displacement zone 638-1, a bridge 656 may extend across the first displacement control element 614-1. Put another way, the first displacement zone 638-1 may be formed as a cut-out of the displacement restraint 616. Similarly, the second displacement zone 638-2 may be formed as a cut-out of the displacement restraint 616, or a bridge may be formed across the second control element 614-2. In some embodiments, forming the displacement restraint 616 from a single, unitary piece may help to increase the rigidity of the displacement restraint 616. A more rigid displacement restraint may help the displacement restraint 616 to prevent deformation or further deformation of the yielding element 602 after the displacement control element 614 has contacted the displacement restraint 616. It may also permit for a more continuous attachment to the other elements of the brace 600.

FIG. 7 is a representation of a top view of a seismic brace 700 having a flowable material 752 filling a spine 704 to act as a displacement restraint, according to at least one embodiment of the present disclosure. The seismic brace shown has eight displacement control elements (collectively 714) connected to the yielding section 712 of the yielding element 702. The eight displacement control elements 714 are located between a first end segment 706-1 and a second end segment 706-2. A stopper 754 may be located in the center of the yielding section 712. The stopper 754 may be rigidly connected to the flowable material 752. Put another way, the stopper 754 may not have any displacement zone surrounding it so that the stopper 754 may not move relative to the flowable material. The displacement control elements 714 and stoppers 754 create deformation zones 740 between them. Multiple displacement control elements 714 on the yielding section 712 may allow for an instance of local deformation in each of the deformation zones 740.

In the embodiment shown, a first deformation zone 740-1 may be located between a first displacement zone 738-1 and a second displacement zone 738-2. A second deformation zone 740-2 may be located between the second displacement zone 738-2 and the stopper 754. A third deformation zone 740-3 may be located between the stopper 754 and a third displacement zone 738-3. A fourth deformation zone 740-4 may be located between the third displacement zone 738-3 and a fourth displacement zone 738-4. Instances of local deformation may occur in each of the deformation zones 740. Contact of the displacement control elements 714 with the flowable material 752 may stop an instance of local deformation and the load may be transferred to the yielding section 712 in another deformation zone 740.

A displacement control element 714 may be located in each of the displacement zones 738. Thus, a first displacement control element 714-1 may be located in the first displacement zone 738-1, a second displacement control element 714-2 may be located in the second displacement zone 738-2, a third displacement control element 714-3 may be located in the third displacement zone 738-3, and a fourth displacement control element 714-4 may be located in the fourth displacement zone 738-3.

In the embodiment shown, each of the displacement control elements 714 extend partially from the yielding section 712 to the spine 704. Put another way, the displacement control elements 714 do not extend all the way from the yielding section 712 to the spine 704. In some embodiments, the flowable material 752 may be located between the displacement control element 714 and the spine 704.

The yielding element 702 may experience a tensile displacement 736. The tensile displacement 736 may cause the yielding section 712 to elongate and initiate yielding in deformation zone 740-2. The yielding section 712 may begin to yield in the other deformation zones but continue to localize in deformation zone 740-2 until the displacement control element 714-2 contacts the displacement restraint at point 726-2. Contact with the displacement restraint at point 726-2 may prevent further elongation of the yielding section 712 in deformation zone 740-1. The tensile displacement 736 may continue to be applied to the yielding element 702, but deformation zones 740-1, 740-3, and 740-4 are required to contribute more evenly to the elongation demand. Likewise, if if the yielding begins to localize in deformation zone 740-1, displacement control device 714-1 will permit elongation in that section only until contact is made with the displacement restraint at point 726-1. Deformation zones 740-3 and 740-4 must then contribute more evenly to the yielding demands on the yielding segment 712.

FIG. 8 is a representation of a top view of a seismic brace 800 having a flowable material 852 filling a spine 804 to act as a displacement restraint, according to at least one embodiment of the present disclosure. The seismic brace shown has four displacement control elements 814 connected to the yielding section 812 of the yielding element 802. In the embodiment shown, each of the displacement control elements 814 extend from the yielding section 812 to the spine 804.

While embodiments and figures of the present disclosure describe and/or illustrate displacement control elements on a seismic brace that are uniform (e.g., having the same size and/or shape), it should be understood that seismic braces of the present disclosure may include any combination of displacement control elements disclosed herein. For example, a seismic brace may include displacement control elements of differing size (such as a combination of the displacement control elements 714 of FIG. 7 and the displacement control elements 814 of FIG. 8) and/or shape (such as a combination of the displacement control elements 314 shown in FIG. 3-1 through FIG. 3-13).

FIG. 9 is a representation of a side-view (e.g., with the yielding section plane extending into and out of the page) of a seismic brace 900 having displacement control elements (collectively 914) that extend transverse or perpendicular to the yielding section plane, according to at least one embodiment of the present disclosure. In the embodiment shown, the displacement control elements 914 may extend into a displacement restraint 916. The displacement restraint 916 may extend along the length of the yielding section 912 above an upper surface of the yielding section 912, between the yielding section 912 and a spine 904. In some embodiments, the displacement restraint 916 may be a face restraint (such as the face restraints 213 of FIG. 2-2).

In some embodiments, displacement control elements 914 that extend perpendicular to the yielding section plane may be longer (e.g., the length of the yielding section width). This may increase the total strength of the displacement control element 914. In the embodiment shown, a first displacement control element 914-1 is located directly across the yielding section 912 from a second displacement control element 914-2. Locating displacement control elements 914 directly across the yielding section 912 may further increase the strength of the displacement control elements 914. Stronger displacement control elements 914 may help to more effectively transfer the seismic load experienced by the seismic brace 900 to a different portion of the yielding section 912.

FIG. 10 is a representation of a top-down view (e.g., with the yielding section plane being parallel to the page) of a seismic brace 1000 having displacement control elements 1016 that extend transverse or perpendicular to the yielding section plan (e.g., the displacement control element 1016 extend into and out of the page), according to at least one embodiment of the present disclosure. In the embodiment shown, the displacement control elements 1016 extend across an entirety of a yielding section width 1024 of the yielding section 1012 of a yielding element 1002. In some embodiments, the displacement control elements 1014 may not extend across the entire yielding section width 1024. For example, the displacement control elements 1014 may extend across 1%, 5%, 10%, 20%, 30%, 40%, 50%, 60%, 70%, 80%, 90%, 95%, 100%, or any value therebetween.

In some embodiments, the extent to which the displacement control elements 1016 extend across the yielding section width 1024 may be based on the anticipated loading of the yielding element 1002. For example, a greater loading of the yielding element 1002 may increase the extent of the displacement control elements 1014 while a lower loading of the yielding element 1002 may decrease the extent of the displacement control elements.

FIG. 11 is a representation of a side-view (e.g., with the yielding section plane extending into and out of the page) of a seismic brace 1100 having displacement control elements (collectively 1114) that extend transverse or perpendicular to the yielding section plane, according to at least one embodiment of the present disclosure. In the embodiment shown, a first displacement control element 1114-1 is staggered across the yielding section 1112 of a yielding element 1102 relative to a second displacement control element 1114-2. This may create a deformation zone 1140 between the first displacement control element 1114-1 and the second displacement control element 1114-2. By staggering the displacement control elements 1114, the deformation zone 1140 may be shortened and/or fewer displacement control elements 114 utilized. Fewer displacement control elements may result in reduction of cost for the overall brace.

In accordance with embodiments of the present disclosure, a seismic brace may continue to support loads after a portion of the yielding element has fractured. For example, as may be seen in FIG. 12-1, the yielding section 1212 of the yielding element 1202 of a seismic brace 1200 has fractured in a second deformation zone 1240-2 at a fracture location 1260 as a result of tensile loading. As may be seen, the yielding section 1212 is no longer continuous and therefore would not be capable of transferring a compressive force 1234 applied to the yielding element 1202 unless the left and right sides of the yielding element 1202 were to bear directly on one another. This bearing condition at the fracture location is rare and cannot be depended upon to transfer compressive force 1234.

During deformation, the displacement control element 1214 moved to the right (e.g., toward the second end transfer segment 1206-2) to contact the displacement restraint 1216. When the displacement control element 1214 contacts the displacement restraint 1216, the displacement restraint 1216 may prevent further deformation (or movement based on the fracture 1260) of the yielding section 1212 within the second deformation zone 1240-2. This may allow the yielding element 1202 to transfer the compressive force 1234 to the rest of the yielding element 1202, in this example at the stopper 1254 location. This condition is capable of transferring a specified compression force 1234 through a segment of the restraining system adjacent to deformation zone 1240-2 while maintaining the fuse-like properties of the yielding segment 1212. This may cause additional deformation in the yielding section 1212 in a different deformation zone (collectively 1240). For example, transfer of the compressive force 1234 may cause localized deformation in the first deformation zone 1240-1, the third deformation zone 1240-3, the fourth deformation zone 1240-4, and combinations thereof. In this manner, despite the fracture 1260, the seismic brace 1200 may continue to provide support to the connected structure.

As may be seen in FIG. 12-2, the yielding section 1214 has fractured under tensile force in the second deformation zone 1240-2 at a fracture location 1260 based on a tensile force 1236 applied to the yielding element 1202. As may be seen, the yielding section 1212 is no longer continuous and therefore would not be capable of transferring a tensile force 1236 applied to the yielding element 1202.

During deformation, the displacement control element 1214 moved to the left (e.g., toward the first end transfer segment 1206-1) to contact the displacement restraint 1216. When the displacement control element 1214 contacts the displacement restraint 1216, the displacement restraint 1216 may prevent further deformation (or movement based on the fracture 1260) of the yielding section 1212 within the second deformation zone 1240-2. This may allow the yielding element 1202 to transfer the tensile force 1236 to the restraining system and through the stopper 1254 to the rest of the yielding element 1202. This may cause additional deformation in the yielding section 1212 in a different deformation zone 1240. For example, transfer of the tensile force 1236 may cause localized deformation in the first deformation zone 1240-1, the third deformation zone 1240-3, the fourth deformation zone 1240-4, and combinations thereof. In this manner, despite the fracture 1260, the seismic brace 1200 may continue to provide support to the connected structure by using a small segment of the restraining system adjacent to deformation zone 1240-2 to transfer the tensile loads from one end of the fractured yielding length 1212 to the other end of the fractured yielding length.

In accordance with embodiments of the present disclosure, a seismic brace 1200 may allow for localized deformation when experiencing both a compressive force 1234 and a tensile force 1236 on the same seismic brace 1200. For example, after localized deformation (up to and including a fracture 1260) in the second deformation zone 1240-2 due to the compressive force 1234, as seen in FIG. 12-1, the loading may switch to a tensile force 1236. This may cause the displacement control element 1214 to move from the right to the left (e.g., from the second end transfer segment 1206-2 end to the first end transfer segment 1206-1 end). When the displacement control element 1214 contacts the displacement restraint 1216 as shown in FIG. 12-2, the tensile load 1236 may be supported by the yielding element 1202. In this manner, a yielding section 1212 may experience localized deformation in different deformation zones 1240 due to both the compressive force 1234 and the tensile force 1236. This may help to increase the versatility and energy absorbing capacity of the seismic brace 1200, even beyond fracture.

FIG. 13 is a representation of an end transfer segment 1306 of a seismic brace 1300 having an end segment global deformation control system 1362, according to at least one embodiment of the present disclosure. Use of global displacement limitation systems would be to limit tensile deformations only at magnitudes that would likely lead to tensile fracture of the yielding element. Thus, the fuse-like nature of the brace would not be impeded except in the condition of imminent tensile fracture of the yielding segment 1302. In some embodiments, end segment global deformation control systems (such as 1362) may be combined with segmental displacement limiting devices (such as 814-1 in FIG. 8) to provide segmental displacement limitation to the final end deformation zone, or segment between the end transfer segment and the first displacement control element attached to the yielding length. A seismic brace 1300 may be connected to a structure with an end transfer segment 1306. The end transfer segment may have any construction, and may include a portion of the yielding element 1302. One or more transfer plates 1364 may be connected to the yielding element 1302 at the end transfer segment 1306. The transfer plate 1364 may be connected to the yielding element transversely or perpendicularly. Including a transfer plate 1364 may help to provide additional support to the yielding element 1302, including support in tension, compression, torsion, stability, and other considerations.

In some embodiments, the end transfer segment 1306 may include an end segment deformation control system 1362. The end segment deformation control system 1362 shown may help to provide limitations for global deformations of the yielding element 1302. The end segment deformation control system 1362 includes a displacement control element 1314 inserted into a displacement zone 1338. In some embodiments, the displacement zone may 1338 may be a hollow or other portion of a flowable material 1352 inserted into a spine 1304.

In some embodiments, when the yielding element 1302 experiences deformation along its length, the flowable material 1352 and the spine/casing 1304 may move based on the deformation. Movement of the spine 1304 may be stopped reduced by contact of the displacement control element 1314 with the flowable material 1352. This may help to reduce the amount of global deformation experienced by the yielding element 1302. In this manner, the total movement of the structure connected to the seismic brace 1300 may be controlled and/or reduced.

FIG. 14 is a representation of an end transfer segment 1406 of a seismic brace 1400 (similar in design to FIG. 1-1) having an end segment deformation control system 1462, according to at least one embodiment of the present disclosure. The seismic brace 1400 may be connected to a structure with an end transfer segment 1406. The end transfer segment may include a transfer plate 1464. The end transfer plate 1464 may be part of the yielding element 1402 or may be connected to the yielding element 1402.

The end segment deformation control system 1462 may further include an end transfer collar 1420. The end transfer collar 1420 may be rigidly connected to the transfer plate 1464. A displacement control element 1414 may be connected to the end transfer collar 1420 and configured to limit global tensile movement of the yielding element 1402. A restraining plate 1468 may be connected to the restraining system spine or face plate 1413 and enclosed within the transfer collar 1420. When the yielding element 1402 deforms, the restraining plate 1468 will stay stationary as it is affixed to the spine or face plate 1413 while the displacement control element 1414 will move with the yielding element 1402 and end segment 1406. Under tensile loading, displacement control element 1414 will move towards restraining plate 1468 until contact is made. When the restraining plate 1468 contacts the displacement control element 1414, further tensile deformation of the yielding element 1402 may be reduced and/or prevented. This may help to limit the global deformation of the yielding element 1402. In this manner, the total tensile movement of the seismic brace 1400 may be controlled and and the risk of tensile fracture reduced.

Figures 3, 4, 5, 6, 7, 8, 9, 10, 11, 12, 13, 14, 15:
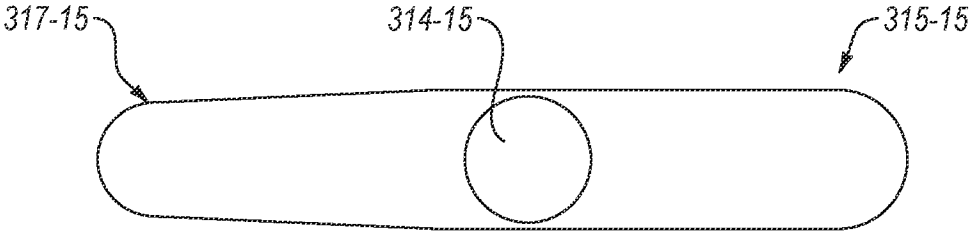

FIG. 15-1 and FIG. 15-2 are representations of an end transfer segment 1506 of a seismic brace 1500 having an end segment deformation control system 1562, according to at least one embodiment of the present disclosure. The seismic brace 1500 may be connected to a structure with an end transfer segment 1506. The end transfer segment may include a transfer plate 1564 connected transversely or perpendicularly to a yielding element 1502.

In some embodiments, a displacement control element 1514 may be connected to an end portion of the yielding element at the end transfer segment 1506. The displacement control element 1514 may extend into a slot 1515 (see FIG. 15-2) in the spine/casing 1504 and any necessary reinforcing plates. Contact of the displacement control element 1514 with the slot 1515 may limit or prevent further deformation of the yielding element 1502. In this manner, the total movement of the structure connected to the seismic brace 1500 may be controlled the risk of tensile fracture reduced.

Figures 3, 4, 5, 6, 7, 8, 9, 10, 11, 12, 13, 14, 15, 16:
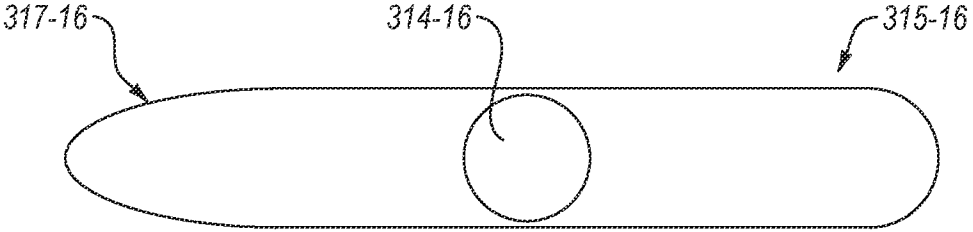
Figure 4:
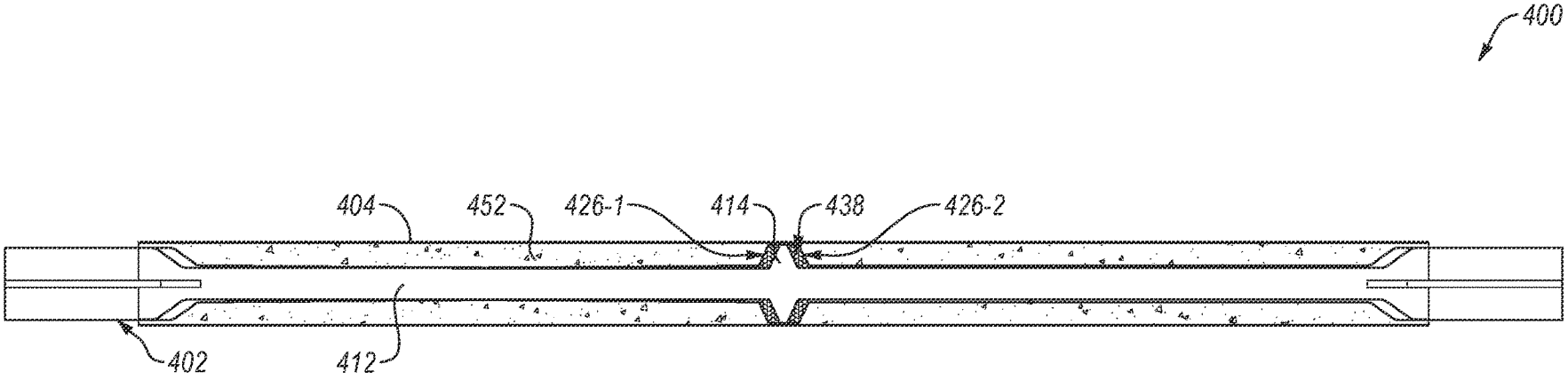
Figure 5:
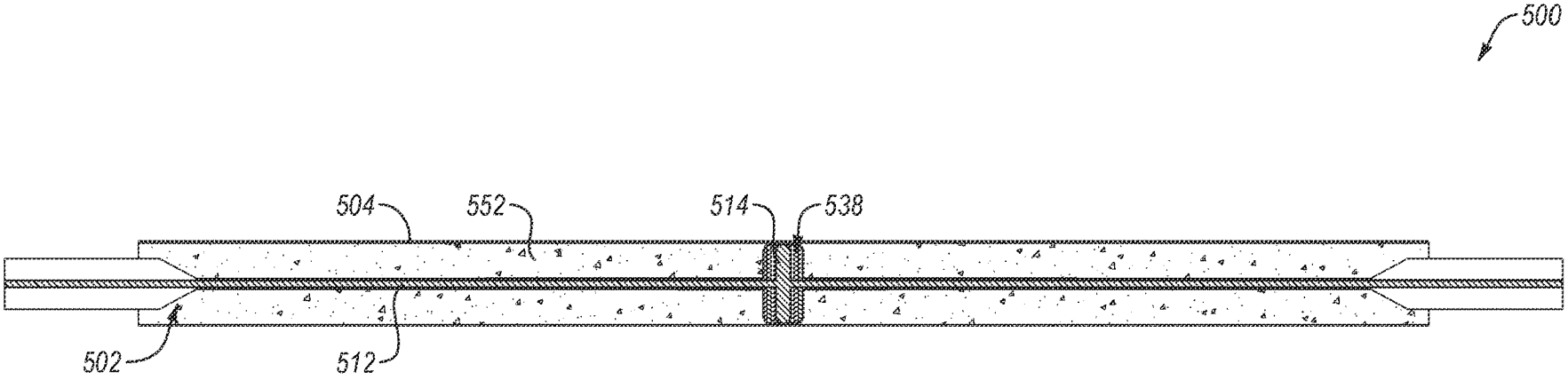
Figure 6:
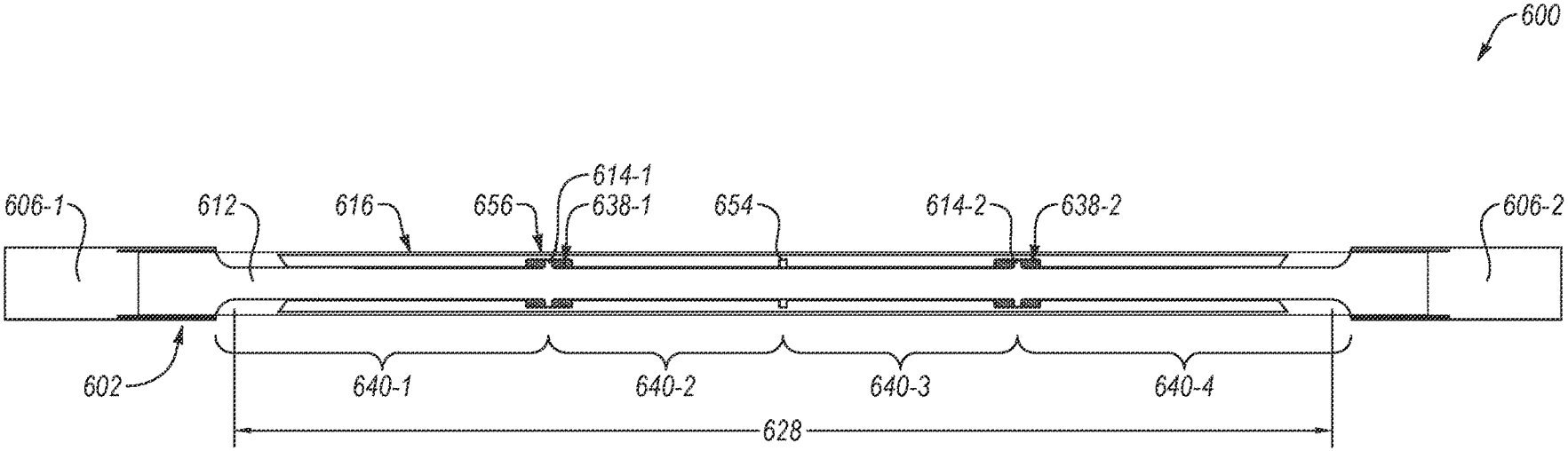
Figure 7:
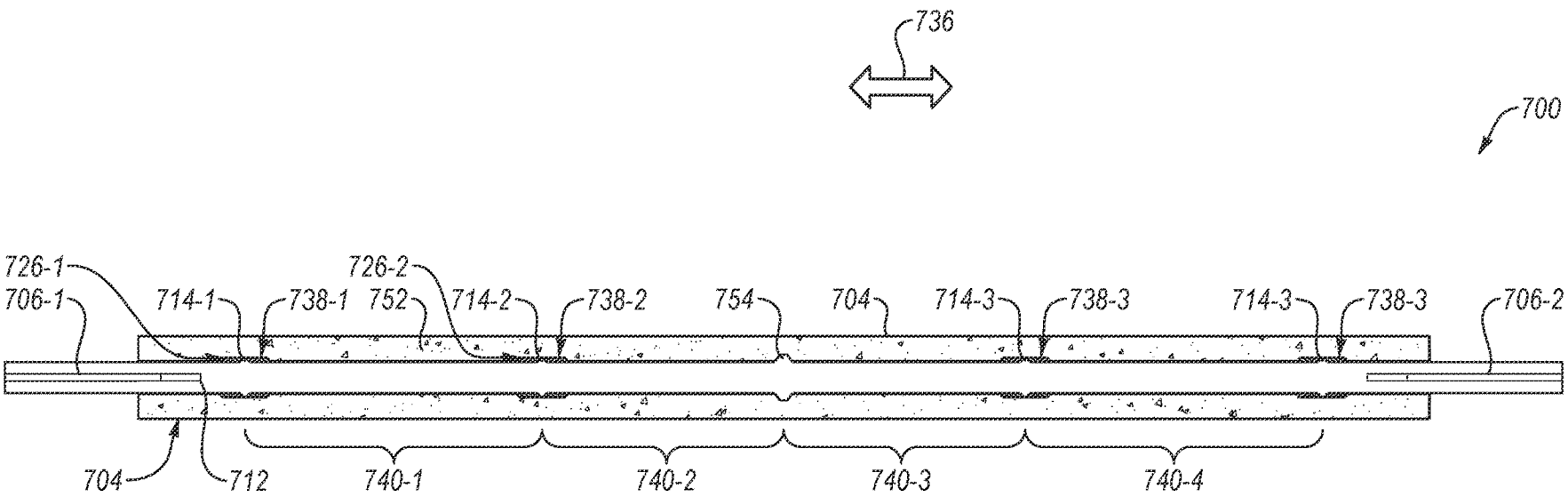
Figure 8:
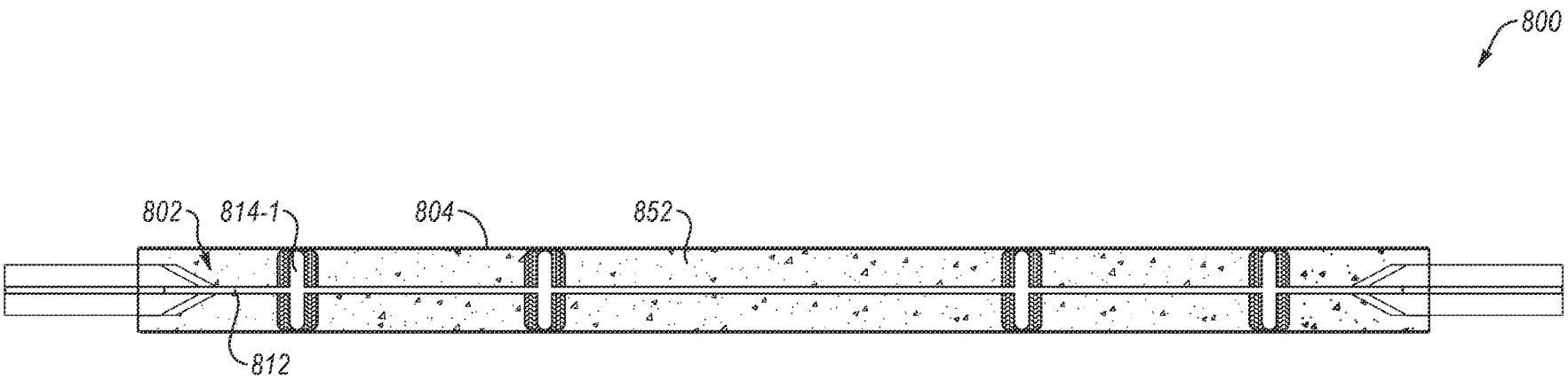
Figure 9:
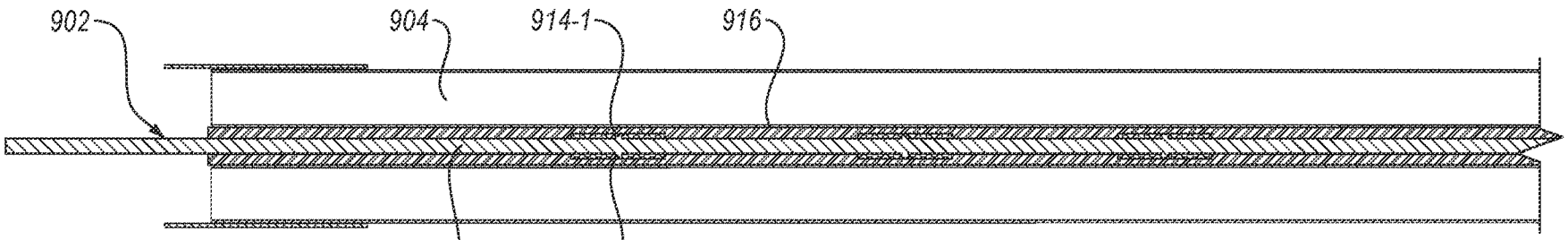
Figure 10:
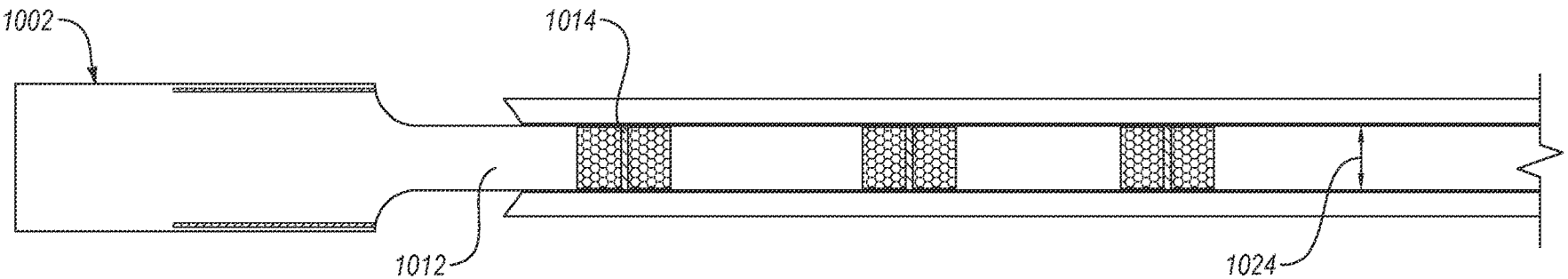
Figure 11:
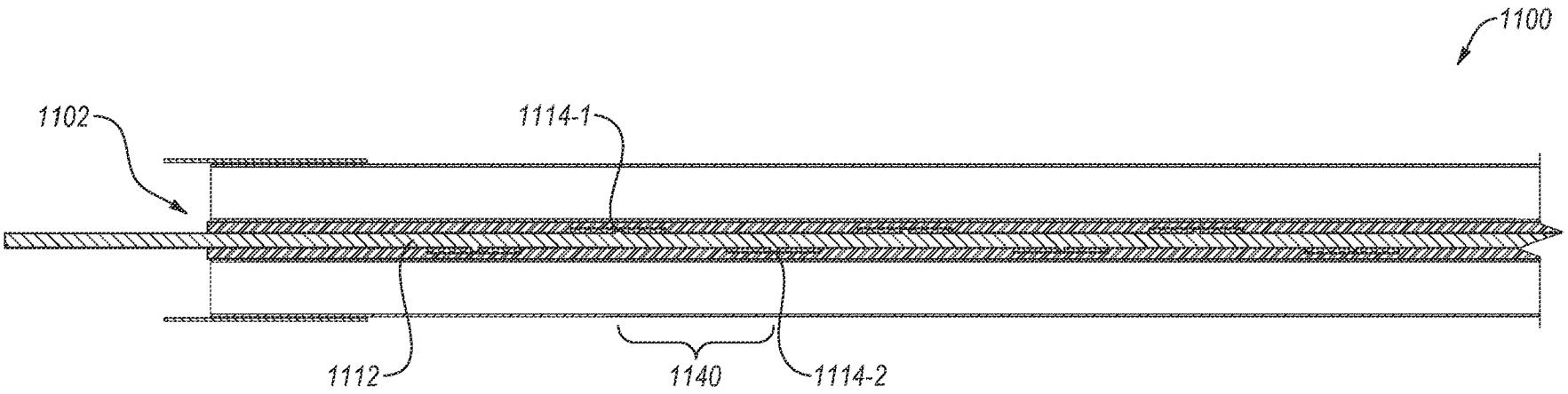
Figures 1, 12:
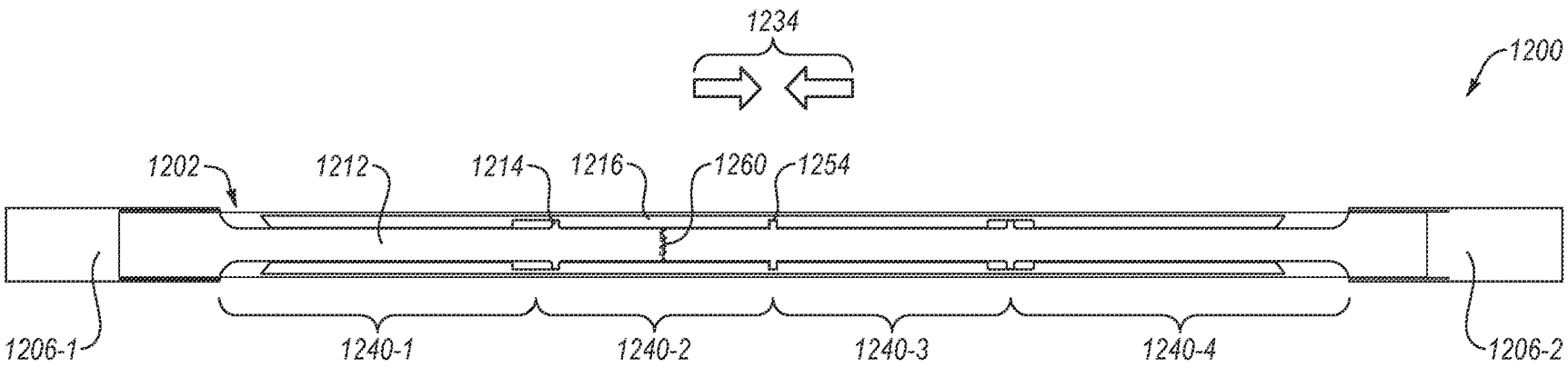
Figures 2, 12:
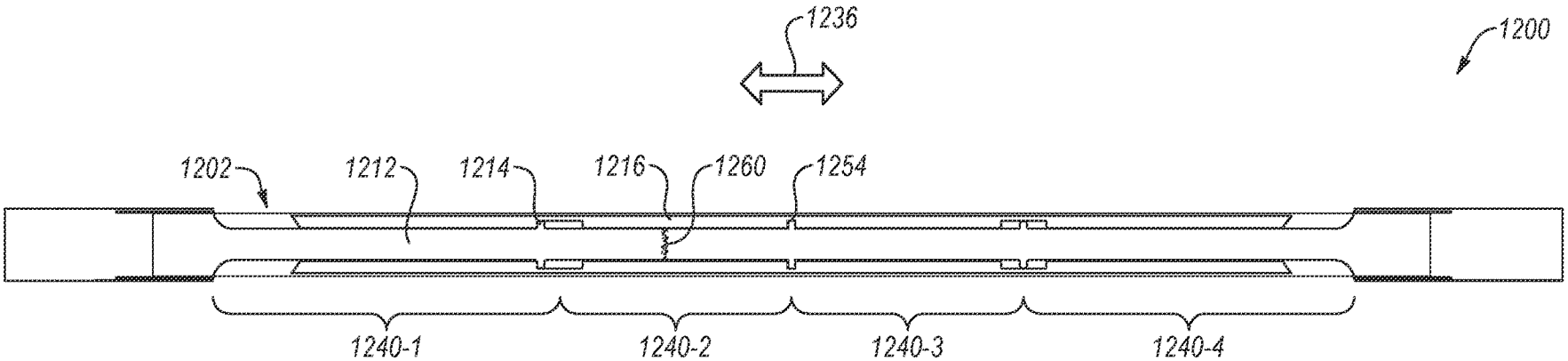
Figure 13:
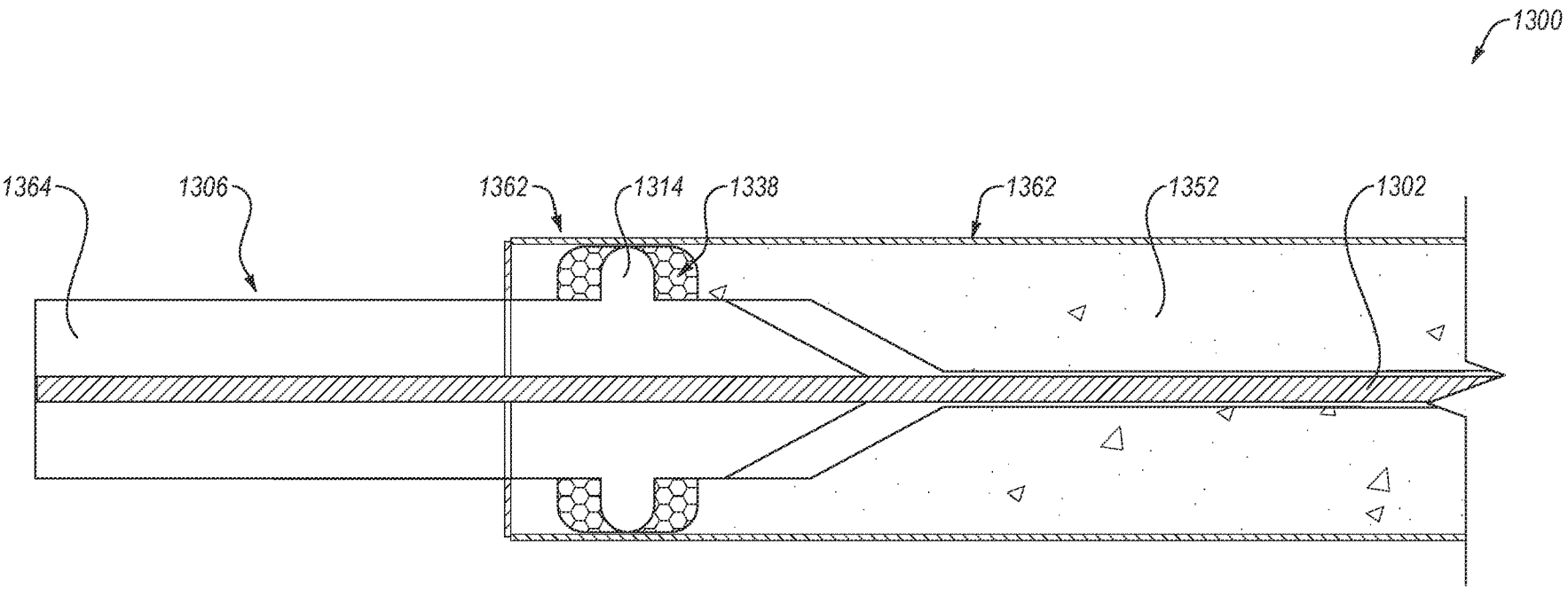
Figure 14:
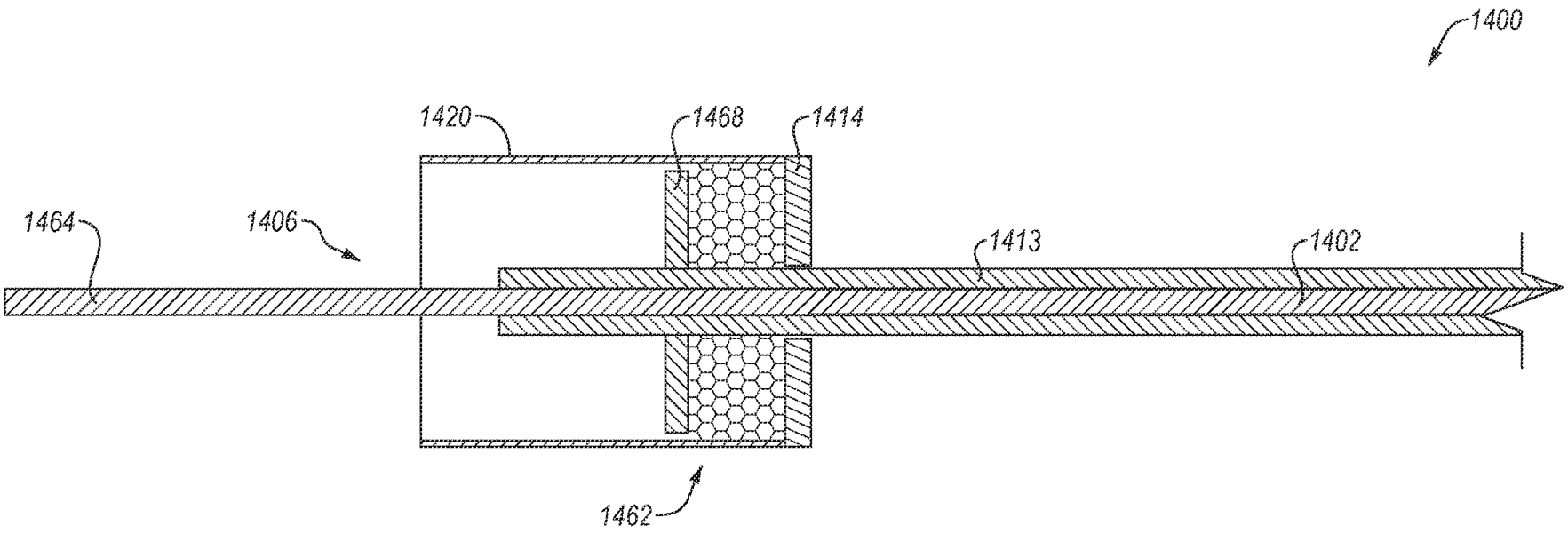
Figures 1, 15:
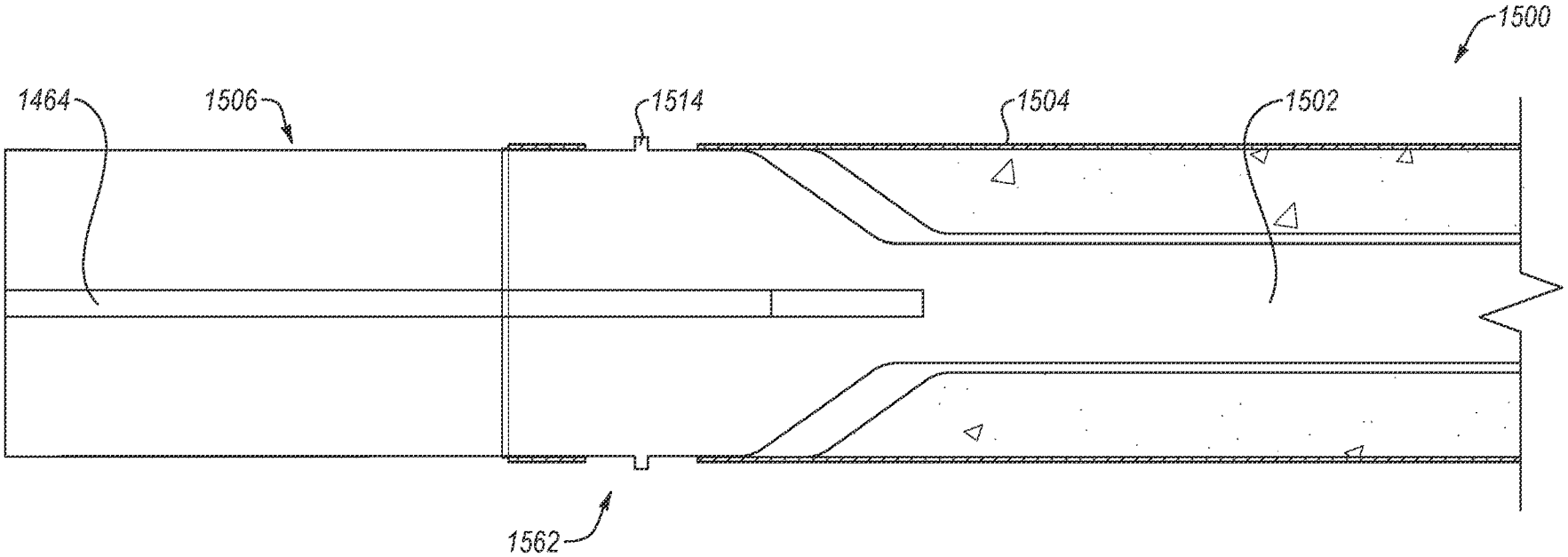
Figures 2, 15:
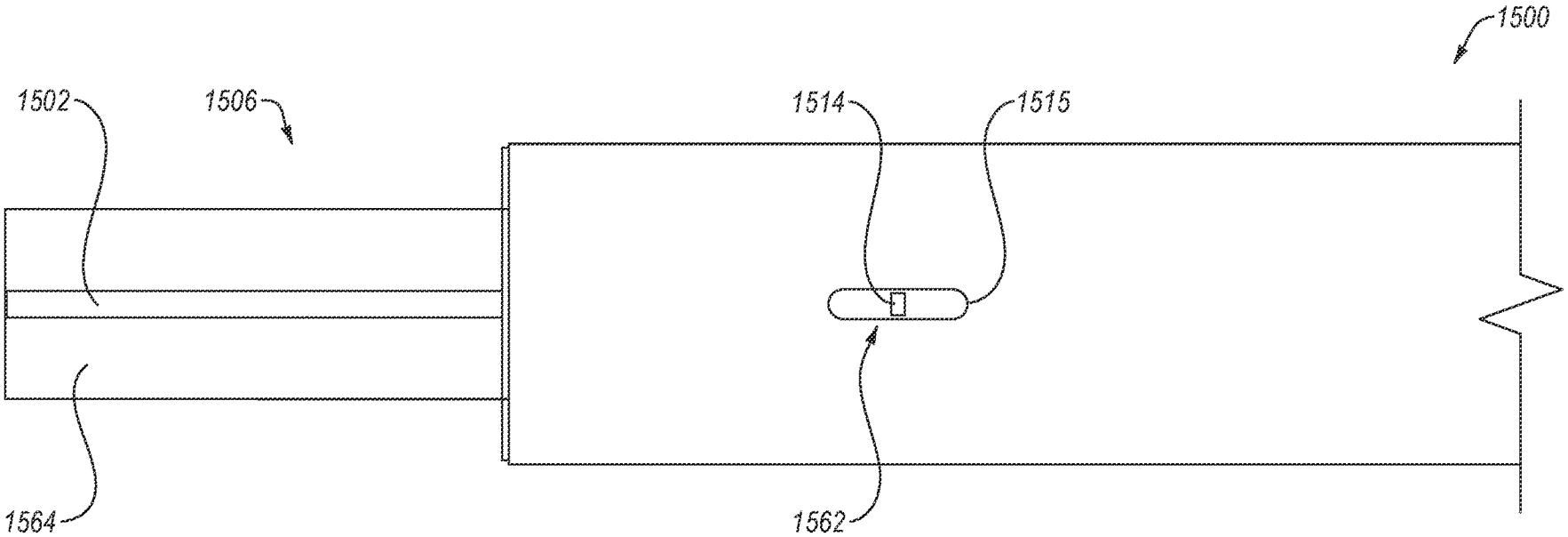
Figures 1, 16:
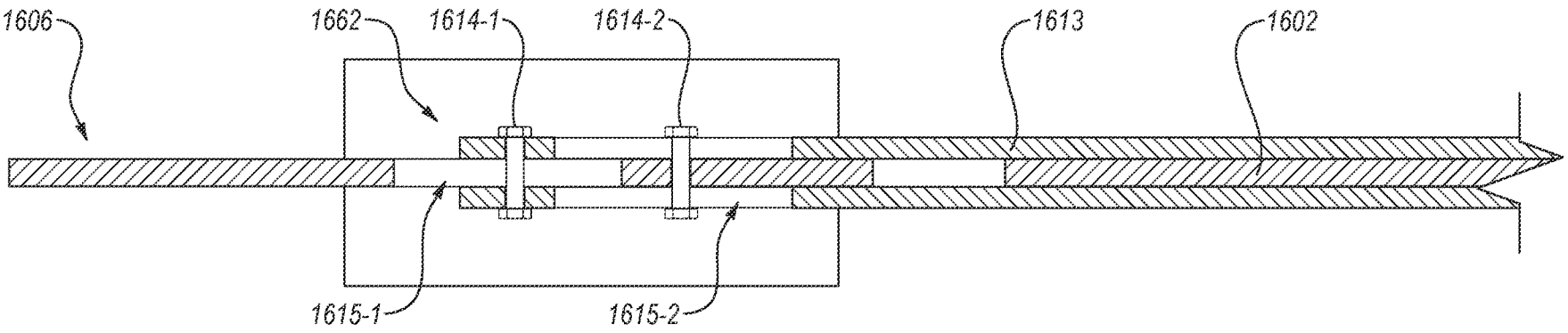
Figures 2, 16:
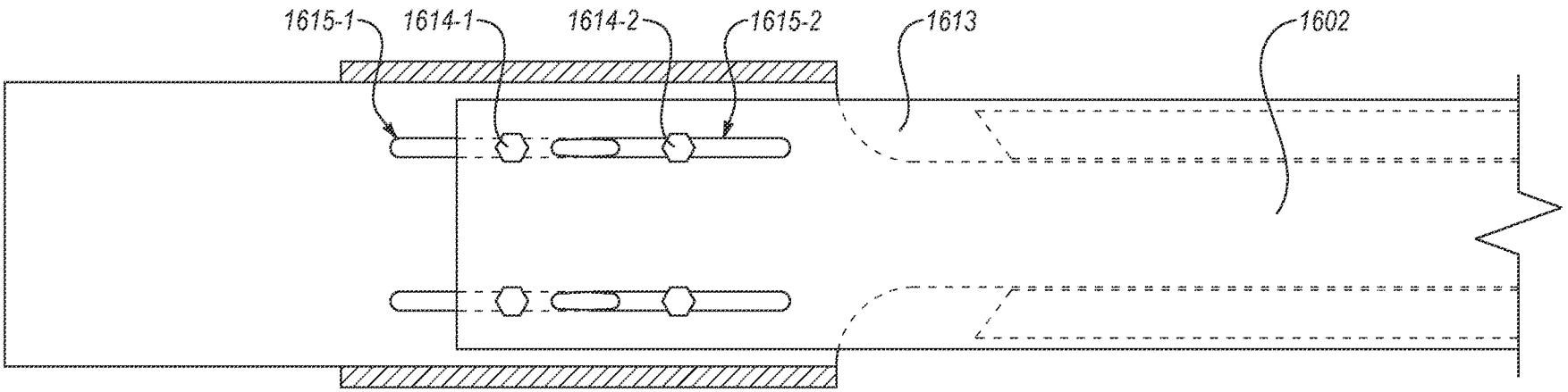

FIG. 16-1 and FIG. 16-2 are representations of an end transfer segment 1606 of a seismic brace 1600 having an end segment deformation control system 1662, according to at least one embodiment of the present disclosure. The seismic brace 1600 may be connected to a structure with an end transfer segment 1606. A face restraint 1613 over the yielding element 1602 may extend into the end transfer segment 1606 (e.g., the widened portion of the yielding element 1602 shown).

In some embodiments, the end segment deformation control system 1662 may include a first slot 1615-1 in the yielding element 1602 and a second slot 1615-2 in the face restraint 1642. The first slot 1615-1 and the second slot 1615-2 may at least partially overlap. A first displacement control element 1614-1 may be inserted through the first slot 1615-1 in the yielding element 1602 and engage with a hole on the face restraint 1642. A second displacement control element 1614-2 may be inserted through the second slot 1615-2 and engage with a hole on the yielding element 1602. In this manner, the first displacement control element 1614-1 may move within the first slot 1615-1 and relative to the yielding element 1602. The second displacement control element 1614-2 may move within the second slot 1615-2 and relative to the face restraint 1642. This, as the yielding element 1602 experiences deformation, global displacement of the yielding element 1602 may be limited by engagement of the displacement control elements 1614 with the ends of the slots. In some embodiments, the combination of the first displacement control element 1614-1 and the second displacement control element 1614-2 may help to maintain the alignment of the face restraint 1642 with the yielding element 1602.

Figures 1, 17:
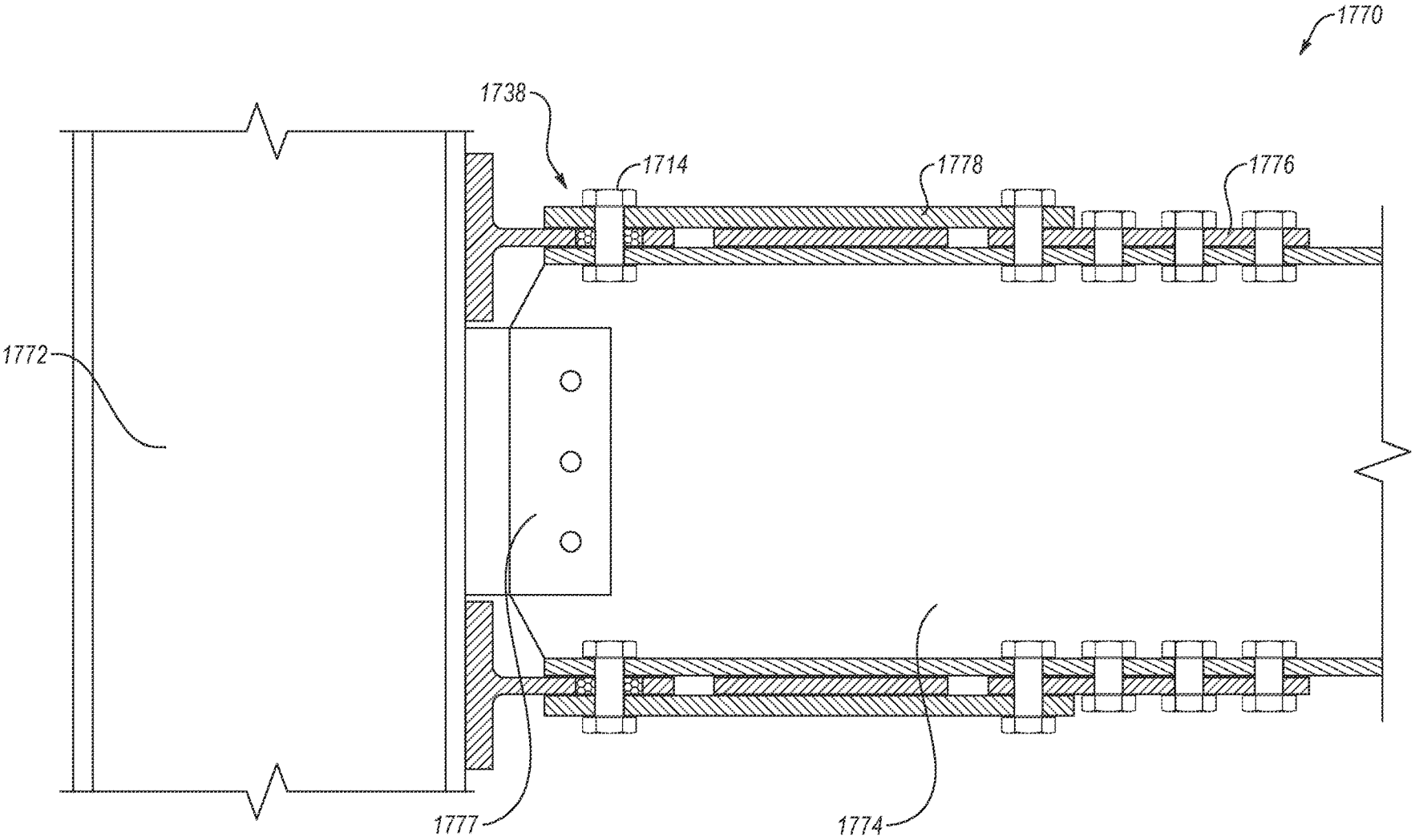
Figures 2, 17:
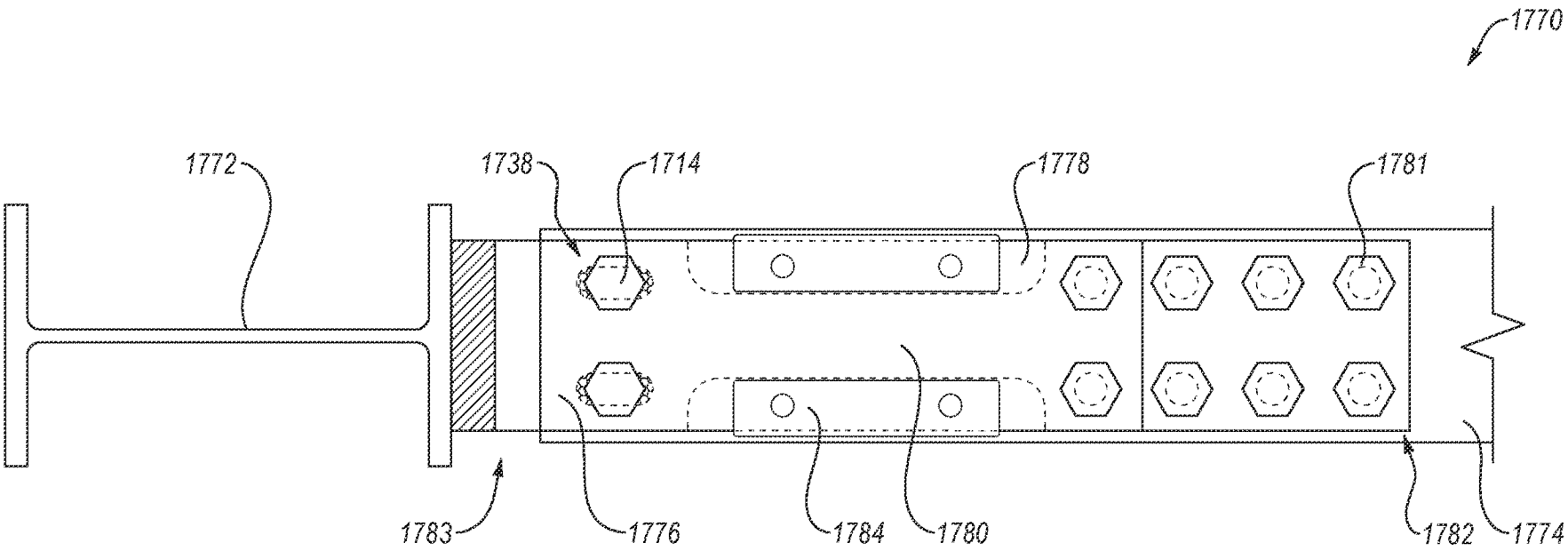

FIG. 17-1 is a representation of a side view of a link displacement system 1770, according to at least one embodiment of the present disclosure. The link displacement system 1770 may be used to provide seismic load support for a link-based moment connection between a structural steel column 1772 and a structural steel beam 1774.

The link displacement system 1770 may include a yielding link 1776. In some embodiments, the yielding link 1776 may be directly connected to the structural steel column 1772. In some embodiments, the yielding link 1776 may be connected to the flange of the structural steel column 1772. In some embodiments, the yielding link 1776 may be connected to the web of the structural steel column 1772. In some embodiments, the yielding link 1776 may be connected to an intermediate element between the structural steel column 1772 and the structural steel beam, such as a bracket, a brace, or other intermediate element.

The yielding link 1776 may extend away from the structural steel column 1772 and parallel to the structural steel beam 1774. In the embodiment shown, the yielding link 1776 extends parallel to the flange of the structural steel beam 1774, however, it should be understood that the yielding link 1776 may extend parallel to the web of the structural steel beam 1774. The yielding link 1776 may be connected to the flange of the structural steel beam 1774 with one or more fasteners, such as a bolt. In some embodiments, the yielding link 1776 may be the only connection between the structural steel beam 1774 and the structural steel column. In some embodiments, the structural steel beam 1774 and the structural steel column may include both a standard bracket 1777 and the yielding link 1776.

The link displacement system 1770 shown further includes a link restraining plate 1778. The link restraining plate 1778 may extend over the top of the yielding link 1776 such that the yielding link 1776 may be located between the link restraining plate 1778 and the flange of the structural steel beam 1774. A displacement control element 1714 may extend through the link restraining plate 1778, the yielding link 1776, and the flange of the structural steel beam 1774. The displacement control element may be located in a displacement zone 1738 of the link restraining plate 1778, the yielding link 1776, and the flange of the structural steel beam 1774. The displacement zone 1738 may include a slot or a slotted hole through each of the link restraining plate 1778, the yielding link 1776, and the flange of the structural steel beam 1774. This may allow movement of the yielding link 1776 relative to the structural steel beam 1774.

FIG. 17-2 is a representation of a top-down view of the link displacement system 1770 of FIG. 17-1, according to at least one embodiment of the present disclosure. As may be seen, the yielding link 1776 includes a link yielding section 1780. The link yielding section 1780 may be a portion of the yielding link 1776 that is configured to intentionally yield before the rest of the yielding link 1776. For example, the link yielding section 1780 shown is a bottlenecked portion of the yielding link 1776, and the narrow section of the link yielding section 1780 may be deformed before the thicker connection portions deform. In some embodiments, the link displacement system 1770 may include a side restraint 1784. The side restraint may help to constrain the deformation of the link yielding section 1780 during seismic loading.

The yielding link 1776 may be connected to the structural steel beam 1774 with one or more bolts 1781 on a beam end 1782 of the yielding link 1776. As discussed above, the yielding link 1776 may be connected to the structural steel column 1772 on a column end 1783 of the yielding link 1776. The link yielding section 1780 may be located between the beam and 1782 and the column end 1783. In some embodiments, the dislocation control element 1714 may extend through the yielding link 1776, the link restraining plate 1778, and the flange of the structural steel beam 1774 at the displacement zone 1738. The displacement zone 1738 may be located on the column end 1783 of the yielding link 1776.

When the structural steel beam 1774 and/or the structural steel column 1772 are subjected to a seismic or other load, the yielding link 1776 may experience a compressive load or a tensile load between the connection to the structural steel beam 1774 at the beam end 1782 and the connection to the structural steel column 1772 at the column end 1783. This may cause the link yielding section 1783 to deform, as discussed herein. When the link yielding section 1783 deforms, the displacement control element 1714 may contact the structural steel beam 1774 at the edge of the displacement zone 1738. This may prevent further deformation of the yielding link 1776. In this manner, the link displacement system 1770 may will permit limited seismic load transfer and energy absorption through the link between two structural steel members, with the displacement control element 1714 only engaging at displacements likely to lead to imminent tensile fracture of the link element. In some embodiments, this may help to improve the seismic stability of a structure.

Figure 18:
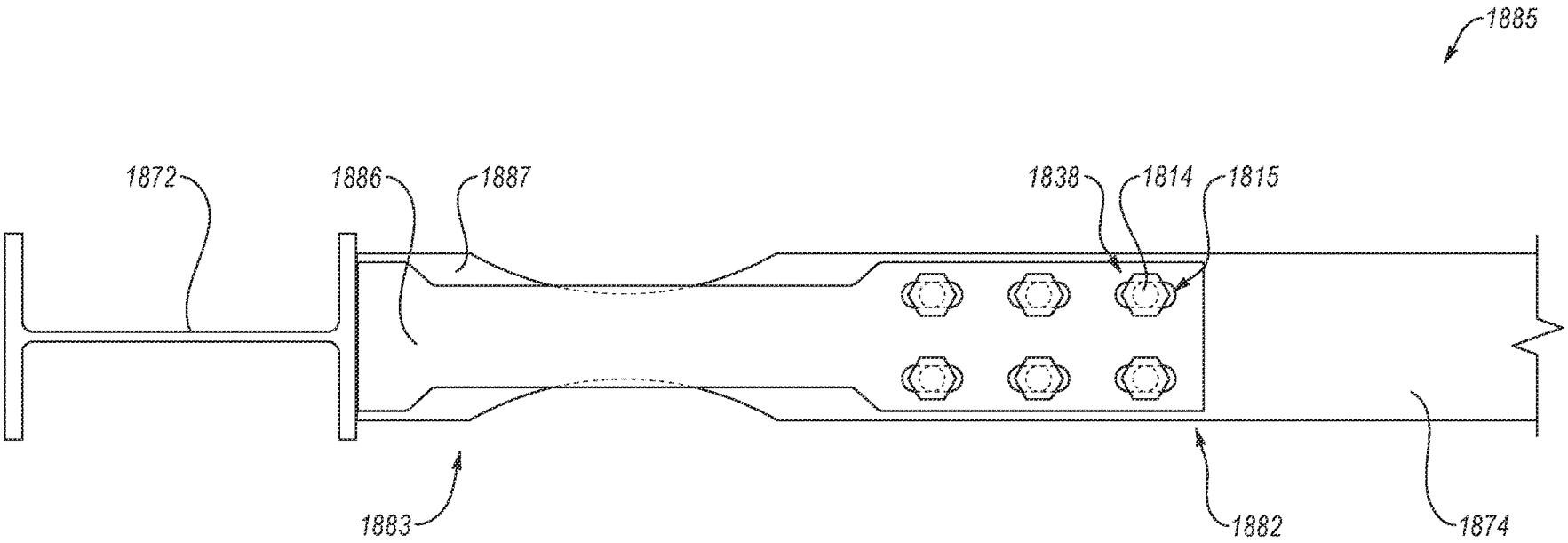
FIG. 18 is a representation of a beam displacement control system, according to at least one embodiment of the present disclosure.

FIG. 18 is a representation of a beam displacement control system 1885, according to at least one embodiment of the present disclosure. The beam displacement control system 1885 includes a structural steel beam 1874 connected to a structural steel column 1872. The structural steel beam 1884 may include a beam yielding section 1887. The beam yielding section 1887 may be a portion of the structural steel beam 1874 that is configured or designed to deform before the rest of the structural steel beam 1874. For example, in the embodiment shown, the beam yielding section 1887 is a necked portion of the flange of the structural steel beam 1874.

A displacement control plate 1886 may be connected to the beam at a column end 1883. One or more displacement control elements 1814 may be fixed to the flange of the structural steel beam 1874. The displacement control element 1814 may extend through a slot 1815 forming the displacement zone 1838. In some embodiments, the displacement control elements 1814 may be a bolt extending through both the flange of the structural steel beam 1874 and the displacement control plate 1886. In some embodiments, the displacement control elements 1814 may be a rod or other steel member welded to or otherwise attached to the flange of the structural steel beam.

The displacement control plate 1886 may be movable relative to the structural steel beam 1874 at a beam end 1882 of the displacement control plate 1886. Thus, if the beam yielding section 1887 deforms, the structural steel beam 1874 may move relative to the displacement control plate 1886. This may cause the displacement control elements 1814 to move within the slot 1815. When the displacement control elements 1814 contact an edge of the slot 1815, the displacement control plate 1886 may prevent further displacement of the structural steel beam 1874 in that direction. Thus, the displacement control elements 1814 will permit limited seismic load transfer and energy absorption through the link between two structural steel members, with the displacement control element 1814 only engaging at displacements likely to lead to imminent tensile fracture of the beam yielding section 1887. In this manner, some seismic stability may be built into the structural steel beam 1874. This may help to improve the seismic stability of a structure.

While the embodiments of FIG. 17-1, FIG. 17-2, and FIG. 18 have been discussed with respect to a displacement control element inserted into a slot, it should be understood that the displacement control elements and/or the displacement zones may have any of the geometries described herein, including the geometries discussed with respect to FIG. 3-1 through FIG. 3-16. Each of the shapes of the displacement control elements may be fixed to the flange of the structural steel beam, with a matching or other associated geometry of displacement zone.

One or more specific embodiments of the present disclosure are described herein. These described embodiments are examples of the presently disclosed techniques. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

The articles "a," "an," and "the" are intended to mean that there are one or more of the elements in the preceding descriptions. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A seismic device, comprising:

a yielding element, including:

a first displacement control element extending from the yielding element; and a second displacement control element extending from the yielding element;

a displacement restraint, wherein the yielding element is axially movable relative to the displacement restraint, wherein the displacement restraint is rigid between the first displacement control element and the second displacement control element, wherein the displacement restraint includes a displacement zone and the first displacement control element is inserted into the displacement zone to limit an axial deformation of the yielding element, wherein the displacement restraint includes a steel plate that extends parallel to a yielding section plane of the yielding element.

2. The seismic device of claim 1, wherein a contact of the first displacement control element with one of the first displacement restraint or the second displacement restraint prevents further axial deformation of the yielding element.

3. The seismic device of claim 1, wherein the yielding element is axially deformable between the first displacement control element and the second displacement control element by a displacement distance within the displacement zone.

4. The seismic device of claim 1, wherein the yielding element includes a plurality of deformation zones, and wherein the yielding element is deformable in at least one of compression or tension in each deformation zone of the plurality of deformation zones.

5. The seismic device of claim 1, wherein the first displacement control element is a stopper rigidly connected to the displacement restraint.

6. The seismic device of claim 5, wherein the yielding element includes a first end transfer segment and a second end transfer segment opposite the first end transfer segment, and wherein the second displacement control element is located between the stopper and the first end transfer segment.

7. The seismic device of claim 6, and further comprising a third displacement control element located between the stopper and the second end transfer segment.

8. The seismic device of claim 1, wherein the first displacement control element is oriented on the yielding section plane of the yielding element.

9. A seismic device, comprising:

a yielding element, including:

a first end transfer segment;

a second end transfer segment; and a displacement control element at the first end transfer segment and extending from the yielding element;

a displacement restraint to the yielding element, the displacement restraint including a displacement zone located at each displacement control element, wherein the displacement restraint includes a steel plate that extends parallel to a yielding section plane of the yielding element.

10. The seismic device of claim 9, wherein the displacement restraint is rigidly connected to the yielding element at the first end transfer segment.

11. The seismic device of claim 9, wherein the yielding element is a beam flange.

12. The seismic device of claim 9, wherein the displacement control element is a bolt and the displacement zone is a slot in the displacement restraint, the bolt configured to slide within the slot.

* * * * *